US012350544B2

(12) United States Patent
Villency et al.

(10) Patent No.: US 12,350,544 B2
(45) Date of Patent: Jul. 8, 2025

(54) CABLE REFORMER

(71) Applicant: INDUSTRIAL DESIGN, LLC, New York, NY (US)

(72) Inventors: Eric Villency, Jupiter, FL (US); Matt Brand, Brooklyn, NY (US)

(73) Assignee: Industrial Design, LLC, Jupiter, FL (US)

( * ) Notice: Subject to any disclaimer, the term of this patent is extended or adjusted under 35 U.S.C. 154(b) by 206 days.

(21) Appl. No.: 18/057,254

(22) Filed: Nov. 21, 2022

(65) Prior Publication Data

US 2023/0158360 A1 May 25, 2023

Related U.S. Application Data

(60) Provisional application No. 63/424,644, filed on Nov. 11, 2022, provisional application No. 63/282,046, filed on Nov. 22, 2021.

(51) Int. Cl.
*A63B 21/00* (2006.01)
*A63B 21/005* (2006.01)
(Continued)

(52) U.S. Cl.
CPC ..... *A63B 21/4029* (2015.10); *A63B 21/005* (2013.01); *A63B 21/154* (2013.01); *A63B 21/4035* (2015.10); *A63B 24/0087* (2013.01); *A63B 71/0619* (2013.01); *A63B 2225/09* (2013.01); *A63B 2225/102* (2013.01)

(58) Field of Classification Search
CPC . A63B 21/4029; A63B 21/005; A63B 21/154; A63B 21/4035; A63B 24/0087; A63B 71/0619; A63B 2225/09; A63B 2225/102; A63B 22/0087; A63B 21/008; A63B 21/02; A63B 71/0622; A63B 21/078; A63B 21/4031; A63B 23/1281; A63B 2022/0079; A63B 2071/0625; A63B 2071/0655; A63B 2208/0228; A63B 2210/50; A63B 2220/51; A63B 2225/20; A63B 2225/50; A63B 21/153;
(Continued)

(56) References Cited

U.S. PATENT DOCUMENTS 4,753,437 A * 6/1988 Lapcevic ..... A63B 21/154 482/99
5,681,249 A * 10/1997 Endelman ..... A63B 21/154 482/133

(Continued)

*Primary Examiner* — Garrett K Atkinson
(74) *Attorney, Agent, or Firm* — BakerHostetler

(57) ABSTRACT

The present disclosure describes an exercise device including a first base and a second base. The first base includes a pair of support handles rotatably connected to the first base, a pair of cable arms rotatably connected to the first base, wherein the pair of cable arms include a first engagement mechanism, an electronic resistance device connected to a pair of cable handles via a pair of cables that pass through a pair of channels defined by the pair of cable arms; and a seat. The second base includes a beam affixed to and connecting the first base and the second base. The beam includes a track, a backrest carriage that is slidably engaged with the track and includes a second and third engagement mechanism, and a backrest rotatably connected to an end of the backrest carriage.

16 Claims, 17 Drawing Sheets

(51) Int. Cl.
*A63B 24/00* (2006.01)
*A63B 71/06* (2006.01)

(58) Field of Classification Search
CPC ..... A63B 21/4045; A63B 22/0046; A63B 21/0058; A63B 21/4043; A63B 23/03541
See application file for complete search history.

(56) References Cited

U.S. PATENT DOCUMENTS

| | | | | |
|---|---|---|---|---|
| 7,597,653 | B1 * | 10/2009 | Lindemeier | A63B 21/155 482/130 |
| 9,974,996 | B2 * | 5/2018 | Kiser | A63B 22/0076 |
| 10,046,193 | B1 * | 8/2018 | Aronson | A63B 21/025 |
| 2002/0058573 | A1 * | 5/2002 | Endelman | A63B 22/0087 482/142 |
| 2005/0085348 | A1 * | 4/2005 | Kiefer | A63B 22/0076 482/72 |
| 2012/0190505 | A1 * | 7/2012 | Shavit | G09B 19/0038 482/8 |
| 2015/0246258 | A1 * | 9/2015 | Hockridge | A63B 21/156 482/99 |
| 2016/0375297 | A1 * | 12/2016 | Kiser | A63B 69/06 482/73 |
| 2021/0331025 | A1 * | 10/2021 | Schrag | A63B 21/4035 |

* cited by examiner

CABLE REFORMER

CROSS-REFERENCE TO RELATED APPLICATIONS

This application claims priority to and the benefit of both U.S. Provisional Application No. 63/424,644, entitled "CABLE REFORMER," filed Nov. 11, 2022 and U.S. Provisional Application No. 63/282,046, entitled "TRU GRIT REFORMER," filed Nov. 22, 2021, and both of which are incorporated by reference entirely herein.

TECHNICAL FIELD

The present description generally relates to exercise equipment and, more particularly, to exercise apparatuses with resistance mechanisms.

BACKGROUND

Strength training involves physical exercises that are designed to improve strength and endurance. Strength training may include the use of weights (e.g., weighted objects, body weight, etc.) to provide resistance that an individual may work against. These weights may be in a variety of forms, such as free weights or machines. Exercise machines are typically dedicated to a single type of motion, such as a chest press, shoulder press, row, pull-down, and the like. Exercise machines are also typically fixtures, as their size and weight render them immovable. Many machines also have limited utility, undesirable form factors, and dated technology. Accordingly, there is a need for updated exercise equipment that can provide training through various exercise motions at various resistances while also remaining compact and movable.

BRIEF SUMMARY OF THE DISCLOSURE

The present disclosure describes an exercise device including a first base and a second base. The first base includes a pair of support handles rotatably connected to the first base, a pair of cable arms rotatably connected to the first base, wherein the pair of cable arms include a first engagement mechanism, an electronic resistance device connected to a pair of cable handles via a pair of cables that pass through a pair of channels defined by the pair of cable arms; and a seat. The second base includes a beam affixed to and connecting the first base and the second base. The beam includes a track, a backrest carriage that is slidably engaged with the track and includes a second and third engagement mechanism, and a backrest rotatably connected to an end of the backrest carriage.

The present disclosure also describes an exercise device including a base and a beam. The base includes a pair of cable arms rotatably connected to the base, wherein the pair of cable arms include a first engagement mechanism, an electronic resistance device connected to a pair of cable handles via a pair of cables that pass through a pair of channels defined by the pair of cable arms, and a seat. The beam is affixed to the base and includes a track, a backrest carriage that is slidably engaged with the track and includes a second and third engagement mechanism, and a backrest rotatably connected to an end of the backrest carriage.

The present disclosure further describes an exercise apparatus. The exercise apparatus comprises a first base having a seat and at least one arm, a second base, and a track operatively coupled and extending between the first base and the second base. The exercise apparatus further comprises a carriage configured to travel along the track between the first base and the second base and pulleys, namely, a first pulley coupled with the first base, a second pulley coupled with the second base, and aa third pulley coupled with the carriage. The third pulley is disposed below the carriage. The exercise apparatus further comprises a first cable forming a loop between the first pulley and the third pulley, and a second cable attached to a hook forming a loop between the second pulley and the third pulley. The first and second cables are disposed below the carriage and the track. The exercise apparatus also comprises a motor operatively coupled with the third pulley and configured to impart a rotational force onto the third pulley.

The summary is intended only to provide examples of certain aspects and should not be read to limit any portion of the disclosure or claims.

BRIEF DESCRIPTION OF THE DRAWINGS

Certain features of the subject technology are set forth in the appended claims. However, for the purpose of explanation, several embodiments of the subject technology are set forth in the following figures.

The foregoing brief descriptions of the drawings are not exhaustive or exclusive descriptions of the drawings and should not be read to limit the disclosure in any manner.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, the subject technology is not limited to the specific details set forth herein and can be practiced using one or more other implementations. In one or more implementations, structures and components are shown in block diagram form in order to avoid obscuring the concepts of the subject technology.

The exercise apparatus, and methods for using the same, of the present disclosure is configurable to provide various exercise motions at various resistances while also remaining compact and movable. Where other exercise machines provide resistance via the use of weights that the user must move, the exercise apparatus of the present disclosure electronically provides various levels of resistance without the need for multiple weights.

Figure 1:
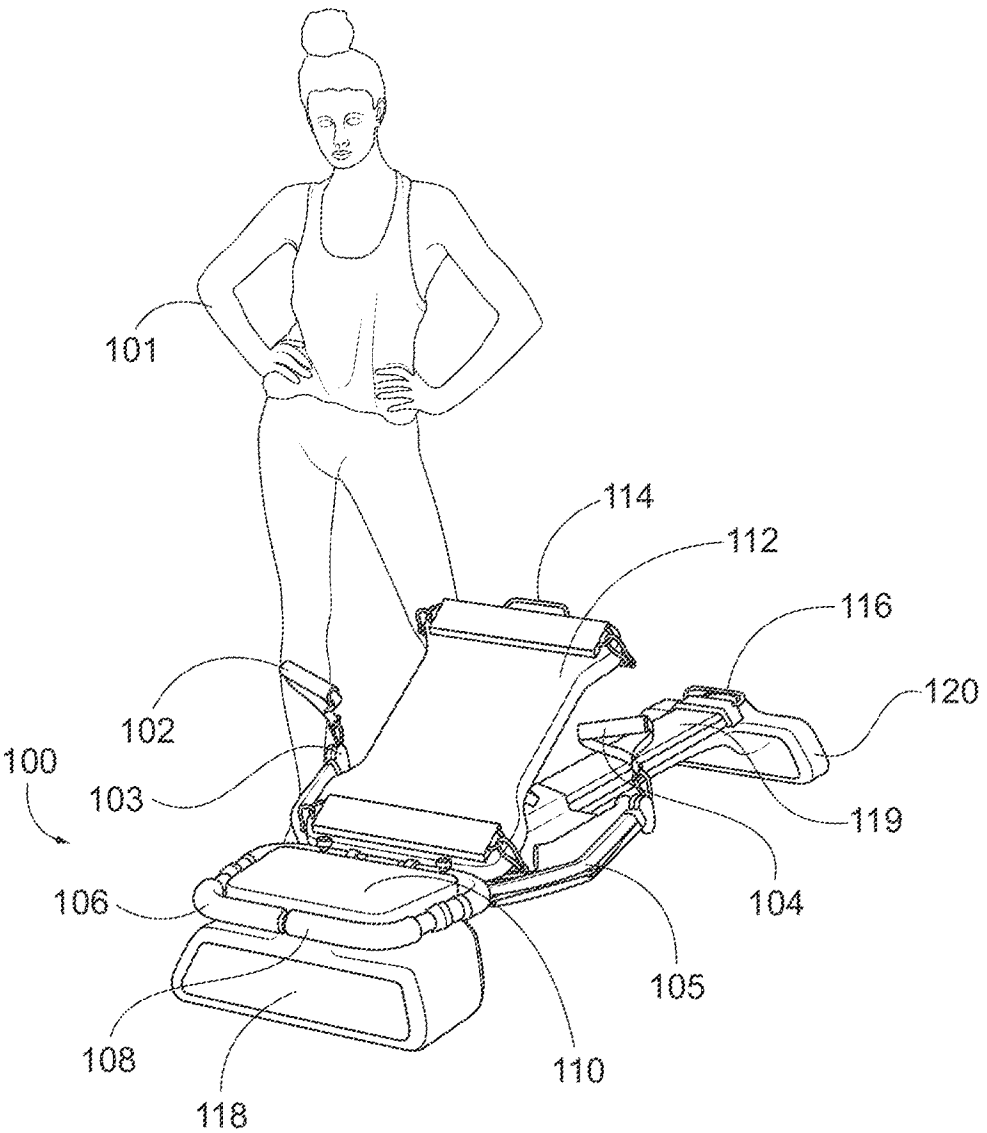
FIG. 1 illustrates a perspective view of an example exercise apparatus, in accordance with one or more implementations.

FIG. 1 illustrates a perspective view of an example exercise apparatus 100, in accordance with one or more implementations. Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided. It should be understood that the depiction of the exercise apparatus 100 are not necessarily to scale and that other sizes of the exercise apparatus 100 are contemplated.

The user 101 may use the exercise apparatus 100 to perform a variety of exercises, such as bench press, incline bench press, shoulder press, bicep curls, and the like. Based on the user's position and configuration of the exercise apparatus 100, many other exercises and variants thereof can be performed. The exercise apparatus 100 may be one piece of equipment for ease of setup. The exercise apparatus 100 may instead be multiple pieces that, when assembled, form the exercise apparatus for ease of storage. The exercise apparatus 100 may be in multiple sizes, such as small, medium, and large, based on the size of the user 101. The exercise apparatus 100 may also or instead be adjustable so that the exercise apparatus 100 may change sizes. The exercise apparatus may include a seat base 118 and a rear base 120.

The seat base 118 may include a pair of support handles 106, 108 rotatably connected to the seat base 118, a pair of cable arms 103, 105 rotatably connected to the seat base 118, one or more electronic resistance devices connected to the pair of cables for applying resistance to the pair of cables (or other elements of exercise apparatus 100 such as, e.g., carriage 130 and backrest 712), and a seat 110 to support the user 101.

The pair of support handles 106, 108 may include a gripping material, such as rubber, for the user 101 to grasp. The pair of support handles 106, 108 and the pair of cable arms 103, 105 may be rotatably connected to the seat base 118 such that they may rotate around an axis that extends laterally along the seat base 118. The rotation mechanism may include hinges, springs, hydraulics, gears, and the like for facilitating the rotation around the axis. Once in position, the pair of support handles 106, 108 and the pair of cable arms 103, 105 may be retained (e.g., held in place). The retention mechanism of support handles 106, 108 in place may include a friction mechanism, ratchets, pins, springs, and the like. The retention mechanism may include a mechanism that is automatically secured when a user adjusts the support handles 106, 108 and/or the cable arms 103, 105, such as a spring-loaded pin that automatically slides into a slide. The retention mechanism may also or instead include a mechanism that is manually secured by the user, such as a screw that the user tightens to hold the support handles 106, 108 and/or the cable arms 103, 105 in place by increasing the friction on the support handles 106, 108 and/or the cable arms 103, 105 or by preventing them from moving. In one or more implementations the support handles 106, 108 and/or the cable arms 103, 105 may be physically coupled such that they move in tandem. The support handles 106, 108 and/or the cable arms 103, 105 may be connected with an axel or any other linkage mechanism that couples the support handle 106 with support handle 108 and/or the cable arm 103 with the cable arm 105, and vice versa. For example, when the user moves the support handle 106, the support handle 108 may move along with the support handle 106.

The electronic resistance device may be integrated into appropriate elements of embodiments disclosed herein, for example, the seat base 118, the support handles 106, 108, or the cable arms 103, 105 or may be an independent device communicatively coupled to one or more of the seat base 118, the support handles 106, 108, or the cable arms 103, 105. The electronic resistance device is connected to a pair of cable handles 102, 104 via a pair of cables that pass through a pair of channels defined by the pair of cable arms 103, 105. For example, the cable arm 103, 105 may be cylindrical and have a hollow cavity through which a cable may be run. The electronic resistance device may be connected to a first end of the cable, and the cable handles 102, 104 may be connected to the second end of the cable. In one or more implementations, the second end of the cable may be connected to a clip such that the cable handle 102, 104 may be replaced with a different cable handle or attachment (e.g., rope, straight handle, bar, V-handle, D-handle). In embodiments, a single handle or component (e.g., wide bar, lat bar) can be attached to both of the clips or other attachment points for cable handle 102, 104.

In embodiments, the electronic resistance device can be a motor disposed in rear base 120. In alternative or complementary embodiments, a motor (or another motor) can be disposed in seat base 118. The motor can be coupled or communicate wirelessly with display 126 and adjustment mechanisms 128 and 129 to send and receive information indicating and controlling an amount and direction of resistance. Exercise apparatus 100 can also include a drive system within beam 119, seat base 118, and/or rear base 120 and coupled to the motor. The linkage can be one or more chains, belts, cables, pulleys, loops, gears, sprockets, et cetera, capable of imparting a force on carriage 130 in either direction along track 136 through mechanical coupling with carriage 130.

The rear base 120 may include a beam 119 affixed to and connecting the seat base 118 and the rear base 120. The beam 119 may be permanently or removably affixed to the seat base 118 and/or the rear base 120. The beam 119 may include a track 136 and a backrest carriage 130 (shown in FIG. 4A and FIG. 4B) slidably engaged with the track 136. The track 136 may be a groove, a channel, a flange, or any other mechanism for holding the backrest carriage 130 in place while allowing the backrest carriage 130 to slide along at least a portion of the beam 119. For example, the backrest carriage 130 includes a set of wheels, and the beam 119 includes a track 136 that retains the set of wheels by way of a flange. The motor can move carriage 130 and backrest 112 along track 136, or can resist movement in a direction to provide the resistance indicated on display 126.

The beam 119 may also include a backrest 112 that is rotatably connected to an end of the backrest carriage 130. The backrest 112 may be raised from the backrest carriage 130 such that one end of the backrest 112 is raised while the other remains connected to the backrest carriage 130. The backrest 112 and/or the backrest carriage may also have a rear backrest engagement mechanism 114, or multiple engagement mechanisms, for connecting to the seat base 118 and/or the rear base 120 (e.g., via the rear base engagement mechanism 116). The rear backrest engagement mechanism 114 and rear base engagement mechanism 116 may include clips, fasteners, hooks, loops, clamps, and the like to retain the backrest carriage in place. In an alternative or complementary embodiment, rear backrest engagement mechanism 114 can have a clamping or other mechanism to fix backrest 112 and carriage 130 at a point along track 136. In addition a window or aperture may be located in the vicinity of rear base engagement mechanism 116 as described hereafter at, e.g., FIG. 10. In embodiments, rear backrest engagement mechanism may complementarily or alternatively be used to detach backrest carriage 130 and backrest 112 from a drive system (described hereafter) to allow free movement, inclining, or removal of carriage 130 and backrest 112 from track 136.

Figure 2A:
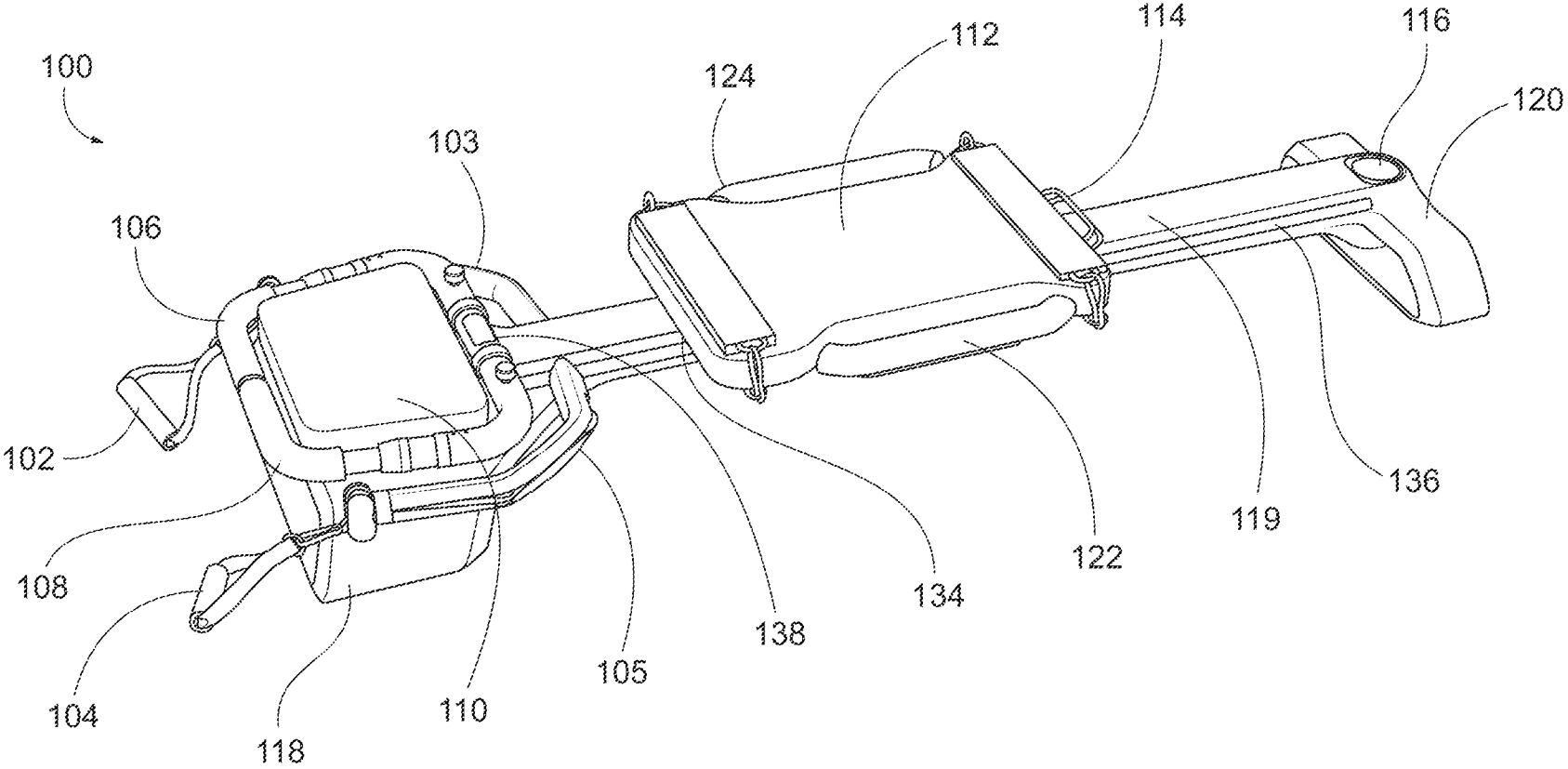
FIG. 2A illustrates another perspective view of the example exercise apparatus of FIG. 1, in accordance with one or more implementations.

FIG. 2A illustrates another perspective view of the example exercise apparatus 100 of FIG. 1, in accordance with one or more implementations. Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

As shown in FIG. 2A, the exercise apparatus 100 is in a first configuration in which the exercise apparatus 100 is flat. To place the exercise apparatus 100 in the first configuration, the support arms 106, 108 may be rotated into a storage configuration. For example, as shown in FIG. 2A, the support arms 106, 108 are rotated such that they are substantially on the same plane as and/or parallel with the nearest edge of the seat 110. The support arms 106, 108 may be held in place by a latch, for example, locking the support arms 106, 108 to the seat base 118 to prevent movement when in a storage configuration.

The cable arms 103, 105 may also be rotated into a storage configuration. For example, as shown in FIG. 2A, the cable arms 103, 105 are extended wider than the support arms 106, 108 and are rotated such that they are substantially on the same plane as and/or parallel to a nearest edge of the seat 110 without colliding with the support arms 106, 108. The cable arms 103, 105 may be held in place by a spring-loaded pin that passes through the cable arms 103, 105 into a slot in the seat base 118, for example, locking the cable arms 103, 105 to the storage configuration. When the cable arms 103, 105 are in the storage configuration, the cable handles 102, 104 may be stored by removing the cable handles 102, 104 from the cables and/or tucking the cable handles 102, 104 into the support base 118.

The backrest 112 may be laid flat such that it is substantially parallel with the beam 119. In one or more embodiments, the backrest 112 may be engaged with the backrest carriage 130 (shown in FIG. 4A and FIG. 4B). The front backrest engagement mechanism 134 may be disengaged from the front base engagement mechanism 138, allowing the backrest carriage 130 to slide along the beam 119. In one or more implementations, when the front base engagement mechanism 138 is disengaged from the front backrest engagement mechanism 134, the electronic resistance device may be deactivated. In one or more implementations, the rear backrest engagement mechanism 114—attached to the opposite side of the backrest 112 and/or backrest carriage 130—may engage with the rear base engagement mechanism 116, holding the backrest carriage 130 in place on the end of the beam 119 closest to the rear base 120.

Figure 2B:
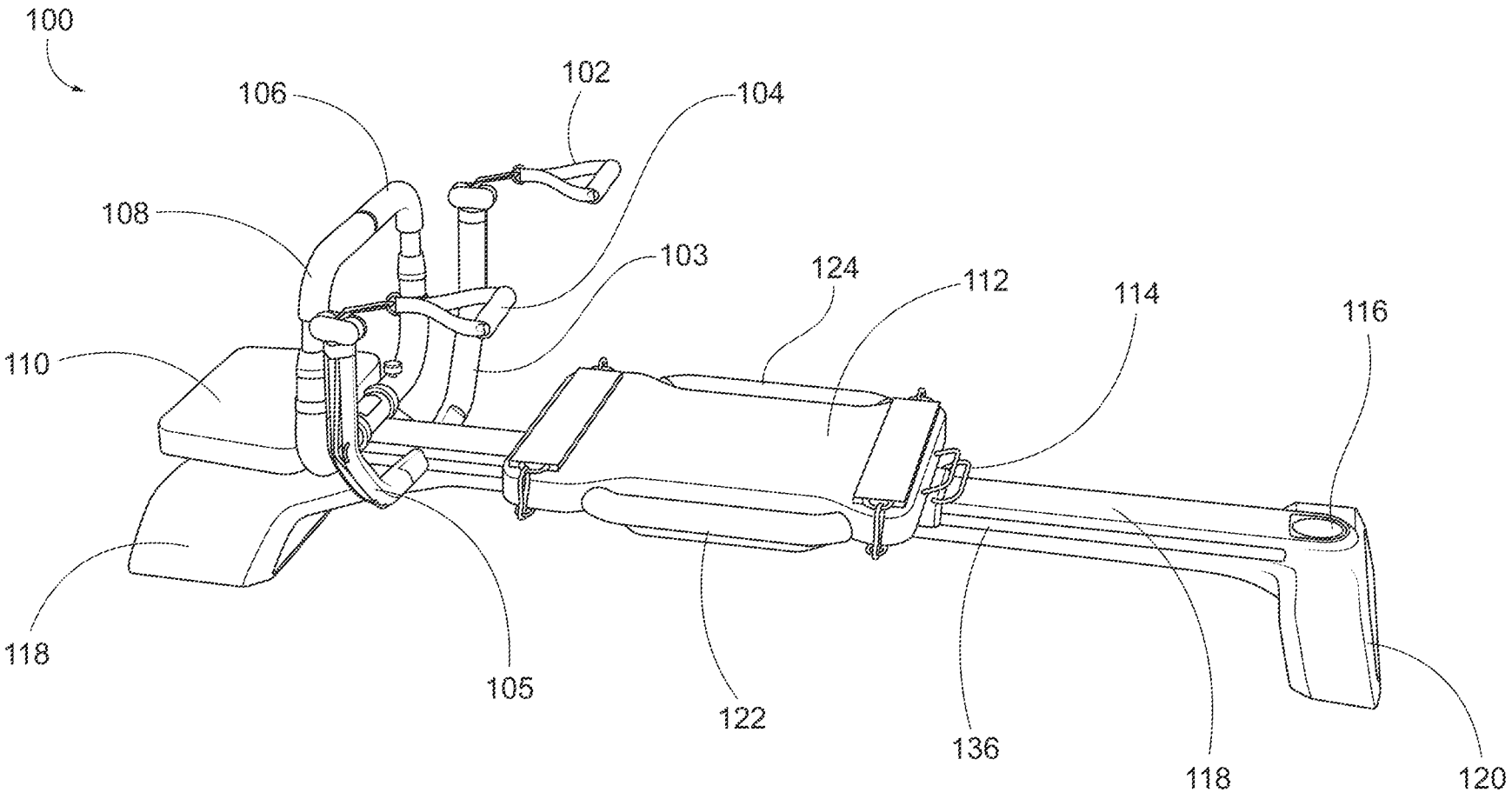
FIG. 2B illustrates a side view of the example exercise apparatus of FIG. 1 with support handles and cable arms in an upright position, in accordance with one or more implementations.

FIG. 2B illustrates a side view of the example exercise apparatus 100 of FIG. 1 with support handles and cable arms in an upright position, in accordance with one or more implementations. Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

As shown in FIG. 2B, the exercise apparatus 100 is in a second configuration in which the support arms 106, 108 and/or the cable arms 103, 105 are rotated into a position for use. The support arms 106, 108 may be rotated into an active configuration. For example, as shown in FIG. 2B, the support arms 106, 108 are rotated such that they are substantially perpendicular to the seat 110. The support arms 106, 108 may be held in place by a spring-loaded pin that passes through the support arms 106, 108, for example, locking the support arms 106, 108 into the active position. It should be understood that the support arms 106, 108 are not limited to the two positions shown in FIG. 2A and FIG. 2B. For example, the support arms 106, 108 may be configured to be held in place in a position in between flat and perpendicular (e.g., 45 degrees) relative to the seat 110.

The cable arms 103, 105 may also be rotated into an active configuration. For example, as shown in FIG. 2B, the cable arms 103, 105 are extended wider than the support arms 106, 108 and are rotated such that they are substantially perpendicular to the seat 110 without colliding with the support arms 106, 108. The cable arms 103, 105 may be held in place by a spring-loaded pin that passes through the cable arms 103, 105 into a slot in the seat base 118, for example, locking the cable arms 103, 105 to the active position. It should be understood that the cable arms 103, 105 are not limited to the two positions shown in FIG. 2A and FIG. 2B. For example, the cable arms 103, 105 may be configured to be held in place in a position in between flat and perpendicular relative to the seat 110.

Figure 3A:
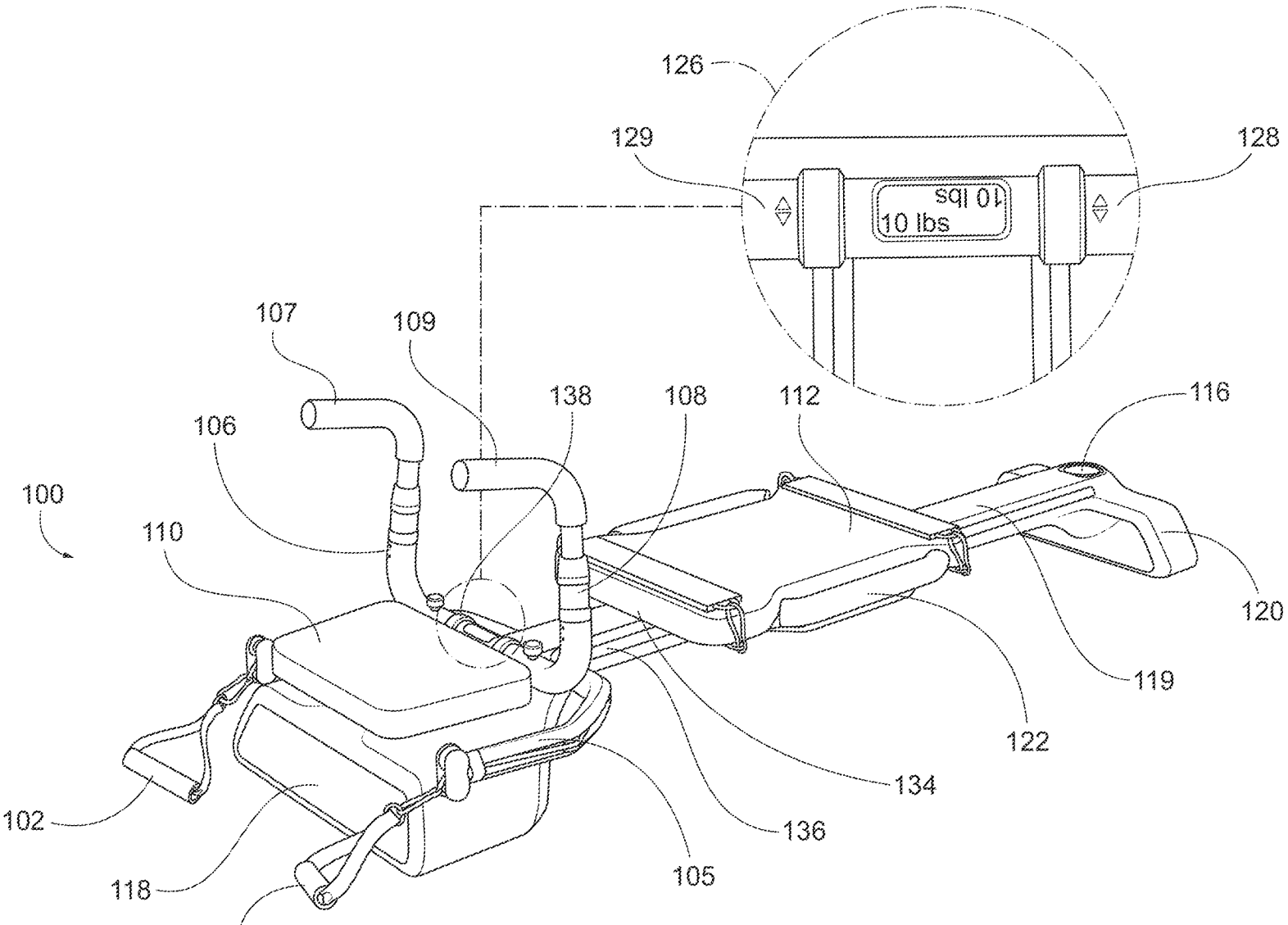
FIG. 3A illustrates a perspective view of the example exercise apparatus of FIG. 1 with a display, in accordance with one or more implementations.

FIG. 3A illustrates a perspective view of the example exercise apparatus 100 of FIG. 1 with a display, in accordance with one or more implementations. Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

As shown in FIG. 3A, the cable arms 103, 105 are in a storage configuration as discussed with regard to FIG. 2A. The support arms 106, 108 are in an active configuration as discussed with regard to FIG. 2B. The support arms 106, 108 may have support handles 107, 109 that may be rotatable relative to the support arms 106, 108. Rotatable support handles 107, 109 may provide additional exercise configurations in which the user may use the support arms 106, 108 and/or the support handles 107, 109 directly to perform an exercise movement (e.g., dips or push-ups) or indirectly to perform an exercise movement (e.g., to prevent the user from rolling off of the exercise apparatus 100).

In one or more implementations, the support handles 107, 109 may be built into the support arms 106, 108. In one or more implementations, the support handles 107, 109 may be a separate piece of material that is slidably engaged with the support arms 106, 108. For example, the support handles 107, 109 may be a separate piece of material having a ninety-degree curve in which one end has a rubberized grip material for the user to grip and the other end slides in the support arms 106, 108 so that the support handles 107, 109 may be extended, retracted, and/or rotated relative to the support arms 106, 108. As shown in FIG. 3A, the support arms 106, 108 are in a position substantially perpendicular to the beam 119 and the support handles 107, 109 are rotated such that they are parallel to the beam 119.

The electronic resistance device of the exercise apparatus 100 may be built into the seat base 118 and/or the rear base 120. The electronic resistance device may include a display 126. The display 126 may present workout information, such as time elapsed, time remaining, amount of resistance applied to the cable handles 102, 104 by the electronic resistance device, and the like. The electronic resistance device may also include one or more adjustment mechanisms 128, 129 to change an amount of resistance and/or a direction of resistance applied to the pair of cables by the electronic resistance device. For example, a first adjustment mechanism 128 may increase or decrease resistance on the cable handles 102, 104 and/or the backrest carriage 130. As another example, a second adjustment mechanism 129 may control the direction of the resistance applied.

Figure 3B:
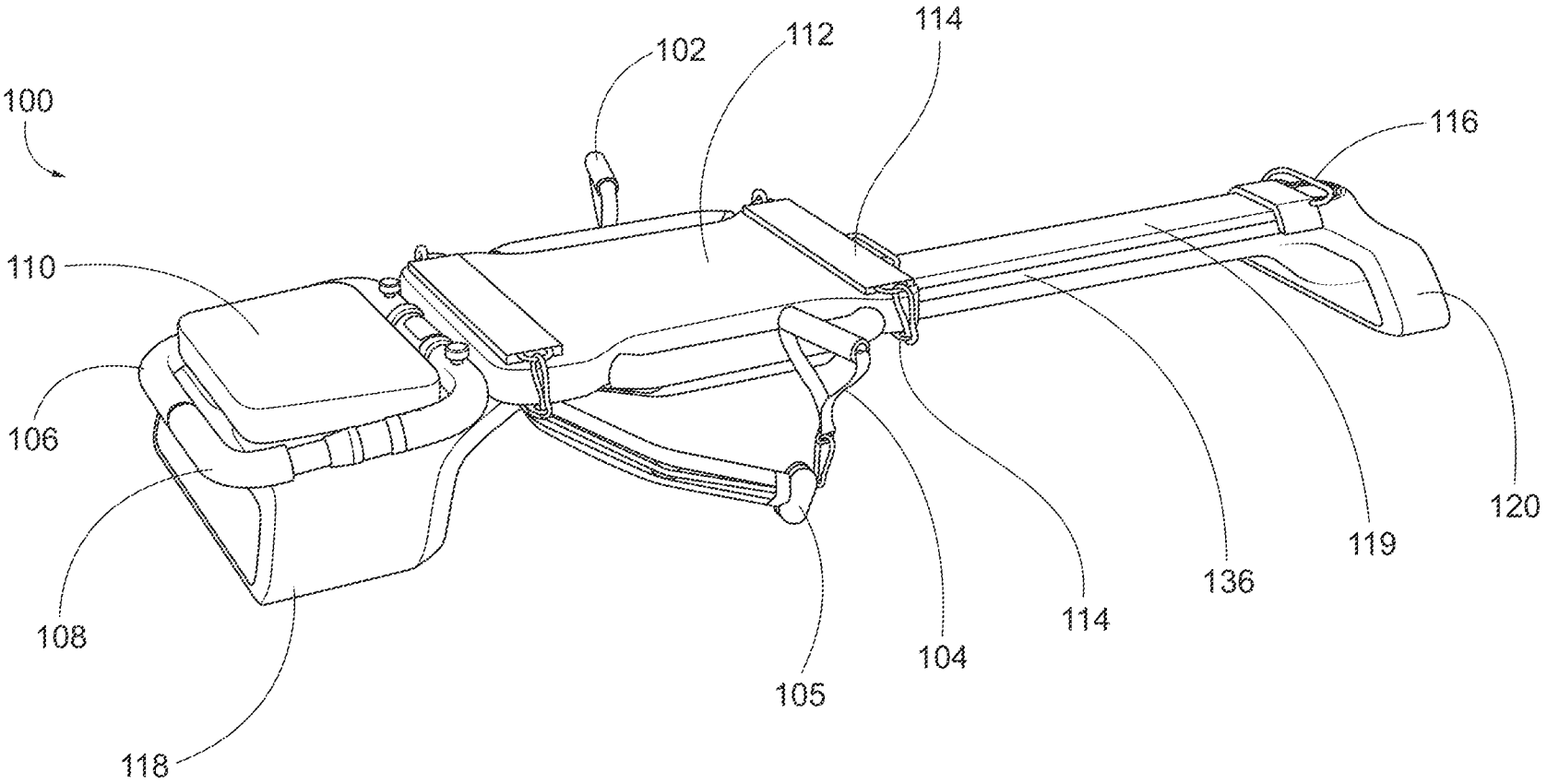
FIG. 3B illustrates the example exercise apparatus of FIG. 1 with the backrest carriage engaged, in accordance with one or more implementations.

FIG. 3B illustrates the example exercise apparatus 100 of FIG. 1 with the backrest carriage 130 (shown in FIG. 4A and FIG. 4B) engaged, in accordance with one or more implementations. Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

A front base engagement mechanism 138 may be included in the seat base 118, the electronic resistance device, the seat 110, the support arms 106, 108, the cable arms 103, 105, and/or the beam 119. The front base engagement mechanism 138 is configured to engage with the front backrest engagement mechanism 134. The front base engagement mechanism 138 may include a latch, hook, loop, clasp, button, pin, and the like. The front backrest engagement mechanism 134 may be included in the backrest 112 and/or the backrest carriage 130. The front base engagement mechanism 138 may include a latch, hook, loop, clasp, button, pin, and the like that engages with the front base engagement mechanism 138.

An electronic resistance device may be included in the seat base 118, the seat 110, the support arms 106, 108, the cable arms 103, 105, and/or the beam 119. When the front base engagement mechanism 138 and the front backrest engagement mechanism 134 are engaged, the backrest 112 and the backrest carriage 130 are held in place and the electronic resistance device is activated. The electronic resistance device is connected to the pair of cable handles 102, 104 such that, when the front base engagement mechanism 138 is engaged with the front backrest engagement mechanism 134, the electronic resistance device applies resistance to the cable handle 102, 104 receiving the force.

The electronic resistance device is configured to impart resistance onto movement (e.g., extension, rotation, and the like) of a cable, a handle, or other component of the exercise apparatus 100. The resistance applied by the electronic resistance device may be configured to require a particular amount of force to be exerted by the user (e.g., 5 lbs., 10 lbs., 20 lbs., etc.) to overcome the resistance so that the user experiences the exercise apparatus 100 as he would traditional exercise equipment that utilizes weighted plates.

The cable arms 103, 105 are configured to rotate, extend, and/or otherwise move such that the cable handles 102, 104 can be placed in several positions and/or distances from the seat 110 to give the user a variety of exercise options, such as angles to which the user may apply force. Accordingly, the active configuration of the cable arms 103, 105 may include rotation toward the rear base 120. For example, as shown in FIG. 3B, the cable arms 103, 105 are rotated such that the cable handles 102, 104 rest below the beam 119. The cable arms 103, 105 may be held in place by a spring-loaded pin that passes through the cable arms 103, 105 into a slot in the seat base 118, for example, locking the cable arms 103, 105 to the active position. Because the backrest carriage 130 is engaged with the electronic resistance device, when a force is applied to the cable handles 102, 104, the electronic resistance device will apply resistance to the connected cable handles 102, 104. It should be understood that other configurations of the cable arms 103, 105 are contemplated.

Figure 4A:
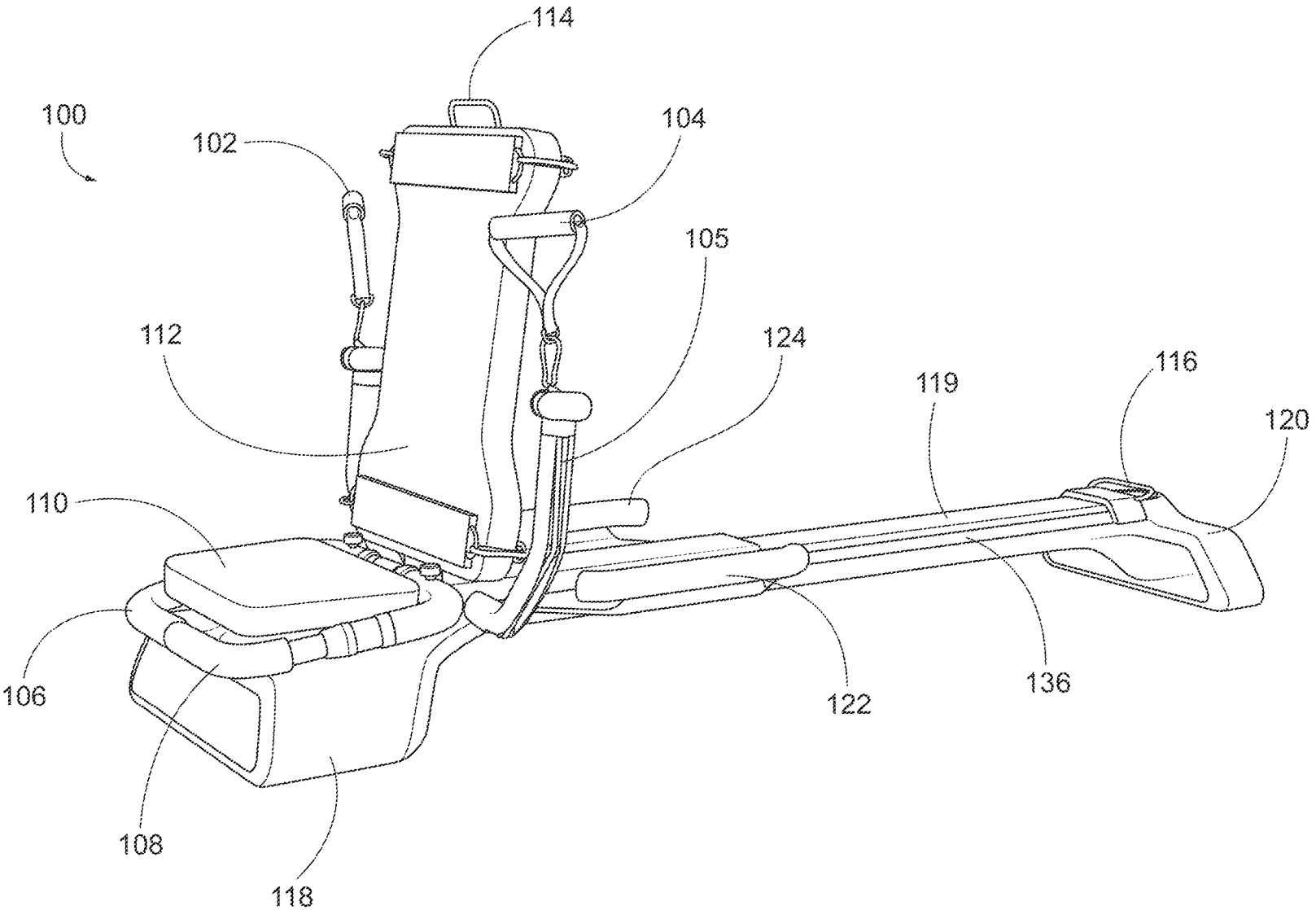
FIG. 4A illustrates a first perspective view of the example exercise apparatus of FIG. 1 in an overhead press configuration, in accordance with one or more implementations.

FIG. 4A illustrates a first perspective view of the example exercise apparatus 100 of FIG. 1 in an overhead press configuration, in accordance with one or more implementations. Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

The overhead press is an upper-body weight training exercise in which the user 101 presses a weight overhead while seated or standing. In an overhead press configuration, the user 101 pushes the cable handles 102, 104 upwards, away from the beam 119. To configure the exercise apparatus 100 for the overhead press exercise, the backrest 112 and the cable arms 103, 105 are on substantially the same plane and are rotated such that the plane is substantially perpendicular to the beam 119 (e.g., 80 degrees, 90 degrees, 100 degrees, etc. relative to the beam 119). For example, the cable arms 103, 105 may be placed in the position shown in FIG. 2B. The front base engagement mechanism 138 and the front backrest engagement mechanism 134 may be engaged to activate the electronic resistance device, e.g., as shown in FIG. 3B so that resistance is applied to the cable handles 102, 104. The support handles 106, 108 may be placed in a storage configuration, e.g., as shown in FIG. 2A.

Figure 4B:
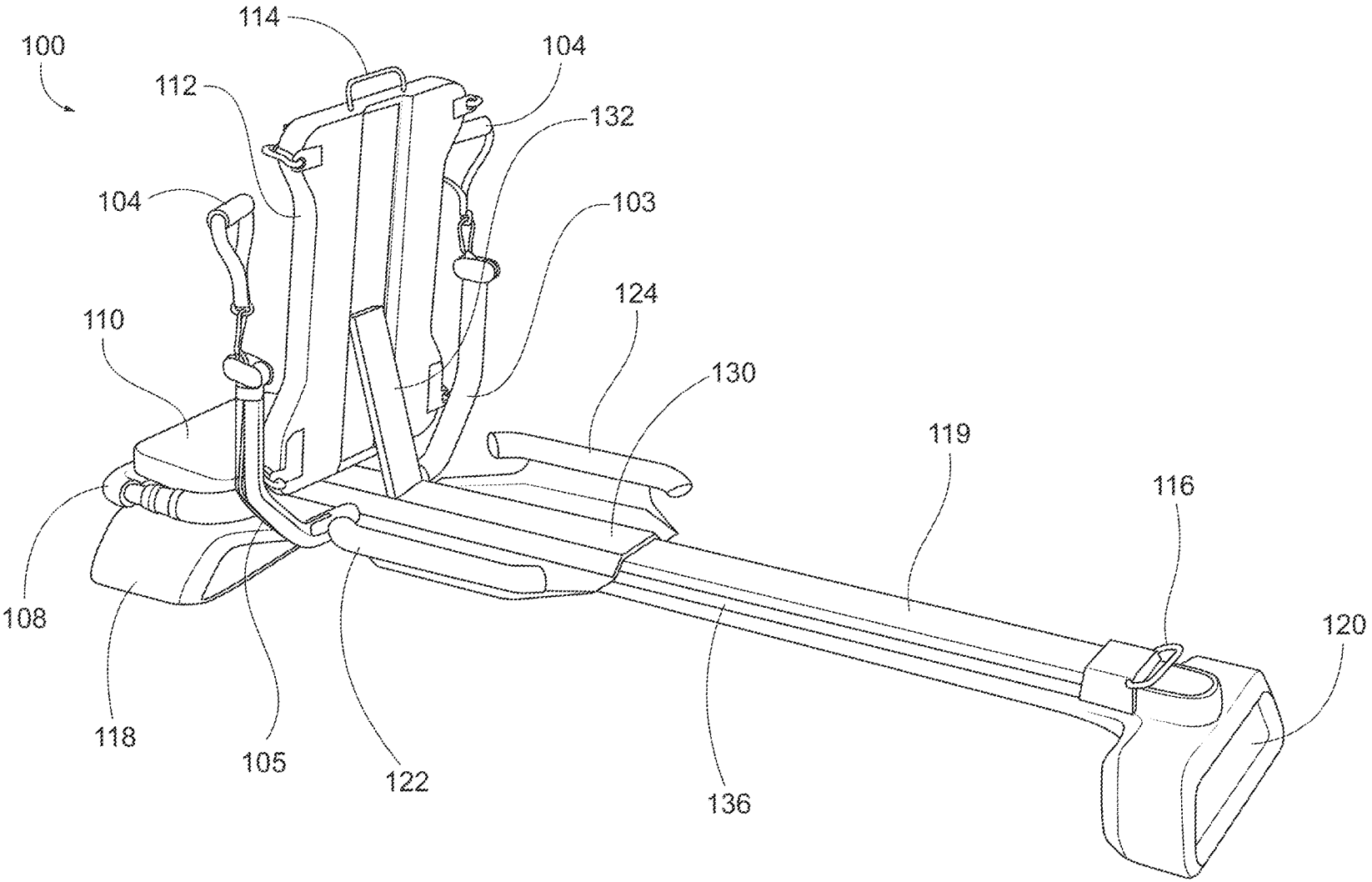
FIG. 4B illustrates a second perspective view of the example exercise apparatus of FIG. 1 in an overhead press configuration, in accordance with one or more implementations.

FIG. 4B illustrates a second perspective view of the example exercise apparatus 100 of FIG. 1 in an overhead press configuration, in accordance with one or more implementations. The backrest carriage 130 is slidably connected to the beam 119. For example, the sides of the beam 119 may each contain a groove (e.g., a track 136) down the length of the beam 119, and at least part of the backrest carriage 130 may be molded to the beam 119 and the groove such that the backrest carriage 130 fits into the groove and can slide along the beam 119 via the groove. The backrest carriage 130 may include a support 132 configured to hold the backrest 112 in an incline or upright position. The support 132 may be rotatably and/or removably connected to the backrest carriage 130. For example, an end of the support 132 may be connected to a hinge, and the hinge is connected to the backrest carriage 130. The side of the backrest 112 that comes into contact with the backrest carriage 130 is configured to receive the support 132. For example, the backrest 112 may include one or more grooves, teeth, slots, and the like for engaging with the support 132 such that the backrest 112 is held in position when the backrest 112 receives the support 132.

In one or more implementations, the backrest carriage 130 may include one or more carriage handles 122, 124 for moving the backrest carriage 130, adding more surface area to the backrest 112 when the backrest 112 is laid against the backrest carriage 130, and/or holding the backrest 112 in place when the backrest 112 is laid against the backrest carriage 130. The carriage handles 122, 124 may be placed on opposing sides of the backrest carriage 130 such that they face away from the seat base 118 and the rear base 120. The carriage handles 122, 124 may be engageable with the backrest 112 for securing the backrest 112 to the backrest carriage 130. For example, the carriage handles 122, 124 and the backrest 112 may include a set of magnets, and the magnets of the carriage handles 122 and 124 attract to the magnets of the backrest 112, thereby holding the backrest 112 against the backrest carriage 130.

Figure 5:
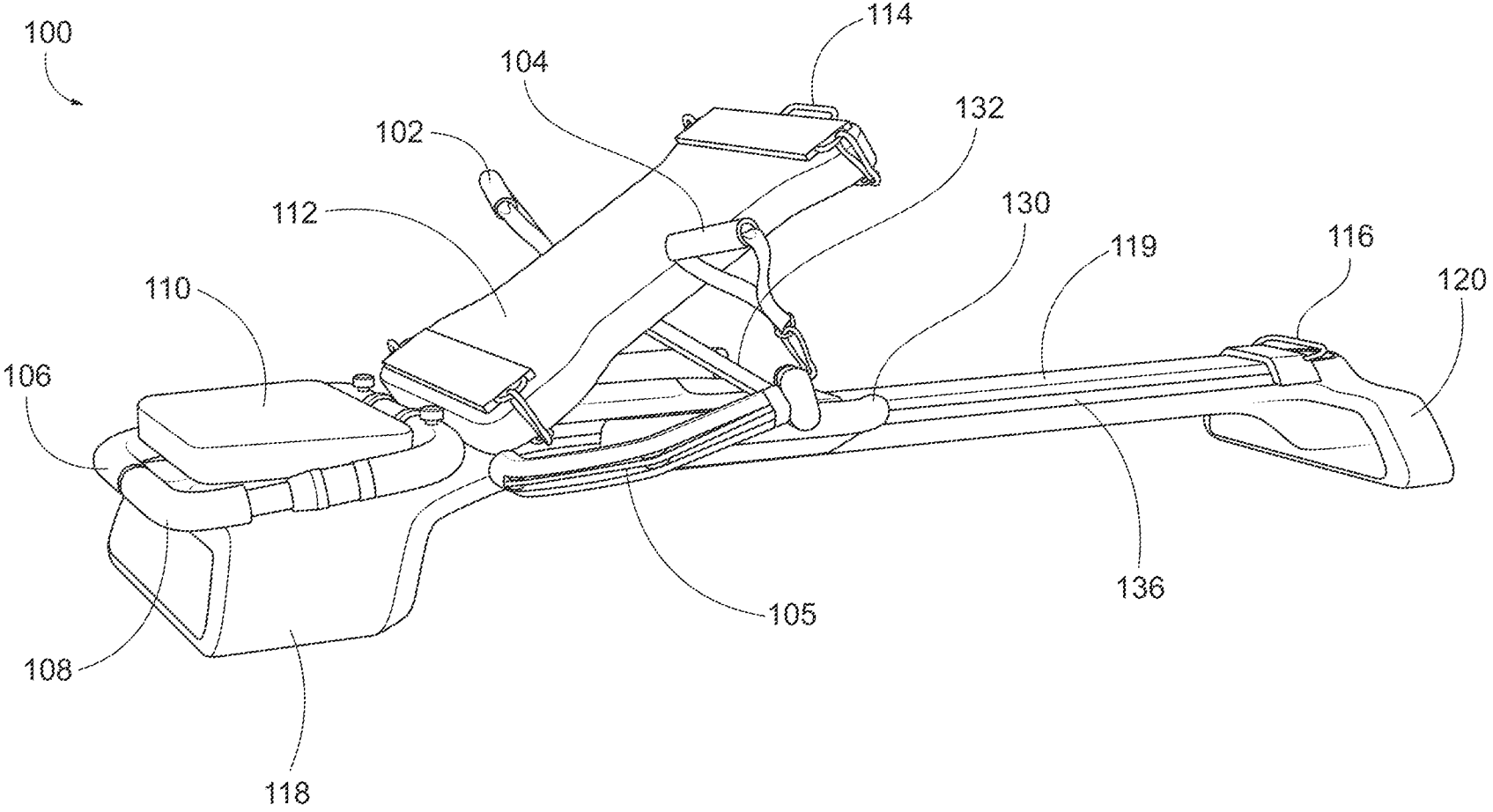
FIG. 5 illustrates the example exercise apparatus of FIG. 1 in an incline bench press configuration, in accordance with one or more implementations.

FIG. 5 illustrates the example exercise apparatus 100 of FIG. 1 in an incline bench press configuration, in accordance with one or more implementations. Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

The incline bench press is an upper-body weight training exercise in which the user 101 presses a weight substantially perpendicular to the beam 119 while the backrest 112 is set at an incline (e.g., fifteen to thirty degrees). In an incline bench press configuration, the user 101 pushes the cable handles 102, 104 upwards, away from the beam 119. To configure the exercise apparatus 100, the backrest 112 may be rotated away from the backrest carriage 130 such that the backrest 112 is inclined and is held in place by the support 132. The cable arms 103, 105 are rotated such that they are substantially parallel to the beam 119 (e.g., 0 degrees, 5 degrees, −5 degrees, etc. relative to the beam 119). For example, the cable arms 103, 105 may be placed in the position shown in FIG. 3B. The front backrest engagement mechanism 134 (attached to the backrest 112 and/or the backrest carriage 130) may be engaged with the front base engagement mechanism 138 to activate the electronic resistance device, e.g., as shown in FIG. 3B so that resistance is applied to the cable handles 102, 104. The support handles 106, 108 may be placed in a storage configuration, e.g., as shown in FIG. 2A.

Figure 6:
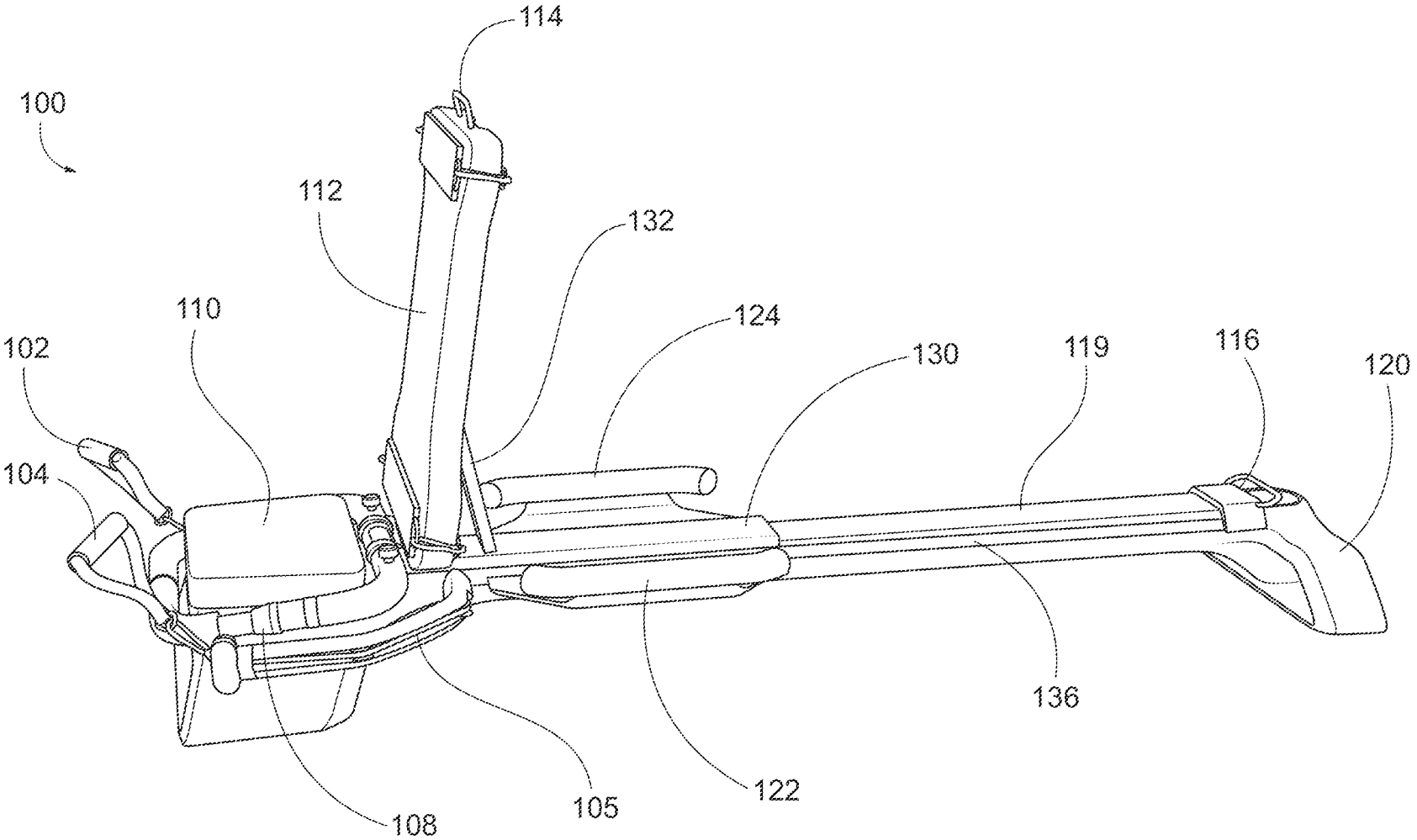
FIG. 6 illustrates the example exercise apparatus of FIG. 1 in a seated bicep curl configuration, in accordance with one or more implementations.

FIG. 6 illustrates the example exercise apparatus 100 of FIG. 1 in a seated bicep curl configuration, in accordance with one or more implementations. Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

The bicep curl is an upper-body weight training exercise in which the user 101 starts with one or both arms in a fully extended position, holding one or both cable handles 102, 104 with a supinated grip and curling (e.g., bending) the elbow until it is fully flexed, then slowly lowering the weight to the starting position. To configure the exercise apparatus 100, the backrest 112 may be rotated away from the backrest carriage 130 such that the backrest 112 is substantially perpendicular to the beam 119 and held in place by the support 132. The cable arms 103, 105 are extended wider than the support arms 106, 108 and are rotated such that they are substantially parallel with the seat 110 (e.g., 0 degrees, 5 degrees, −5 degrees, etc., relative to the seat 110) without colliding with the support arms 106, 108. For example, the cable arms 103, 105 may be placed in the position shown in FIG. 2A. The cable arms 103, 105 may be held in place by a spring-loaded pin that passes through the cable arms 103, 105 into a slot in the seat base 118, for example, locking the cable arms 103, 105 in the storage configuration. The front backrest engagement mechanism 134 (attached to the backrest 112 and/or the backrest carriage 130) may be engaged with the electronic resistance device, e.g., as shown in FIG. 3B, so that resistance is applied to the cable handles 102, 104 when a force is applied to the cable handles 102, 104 by the user 101.

It should be understood that other configurations of the exercise apparatus 100 other than those shown in the FIGS. 1-6 and that other exercises are contemplated beyond shoulder press, incline chess press, and bicep curls. For example, the exercise apparatus 100 may be configured for lower body and core exercises.

There are a variety of methods for using the apparatuses disclosed herein. In an embodiment, a method for using an exercise device including positioning a first base comprising a seat, a support handle, and a cable arm. The method also includes positioning a beam comprising a back rest and a back rest carriage, wherein the beam connects the first base to a second base. The method further includes moving at least one of the support handle or the cable arm from a first position to a second position, wherein the support handle and the cable arm are rotatably connected to the first base, and locking the at least one of the support handle or the cable arm to the second position. The method can further include activating an electronic resistance device by engaging a first engagement mechanism of the first base to a second engagement mechanism of a back rest carriage, wherein the electronic resistance device is connected to a cable handle via a cable that passes through a channel defined by the cable arm; selecting, on a display of the electronic resistance device, an amount of resistance applied to the cable handle; and applying a force to the cable arm, wherein the force counteracts the resistance. The method can further or alternatively include moving the back rest from a first position to a second position and locking the back rest to the second position with a support.

Figure 7A:
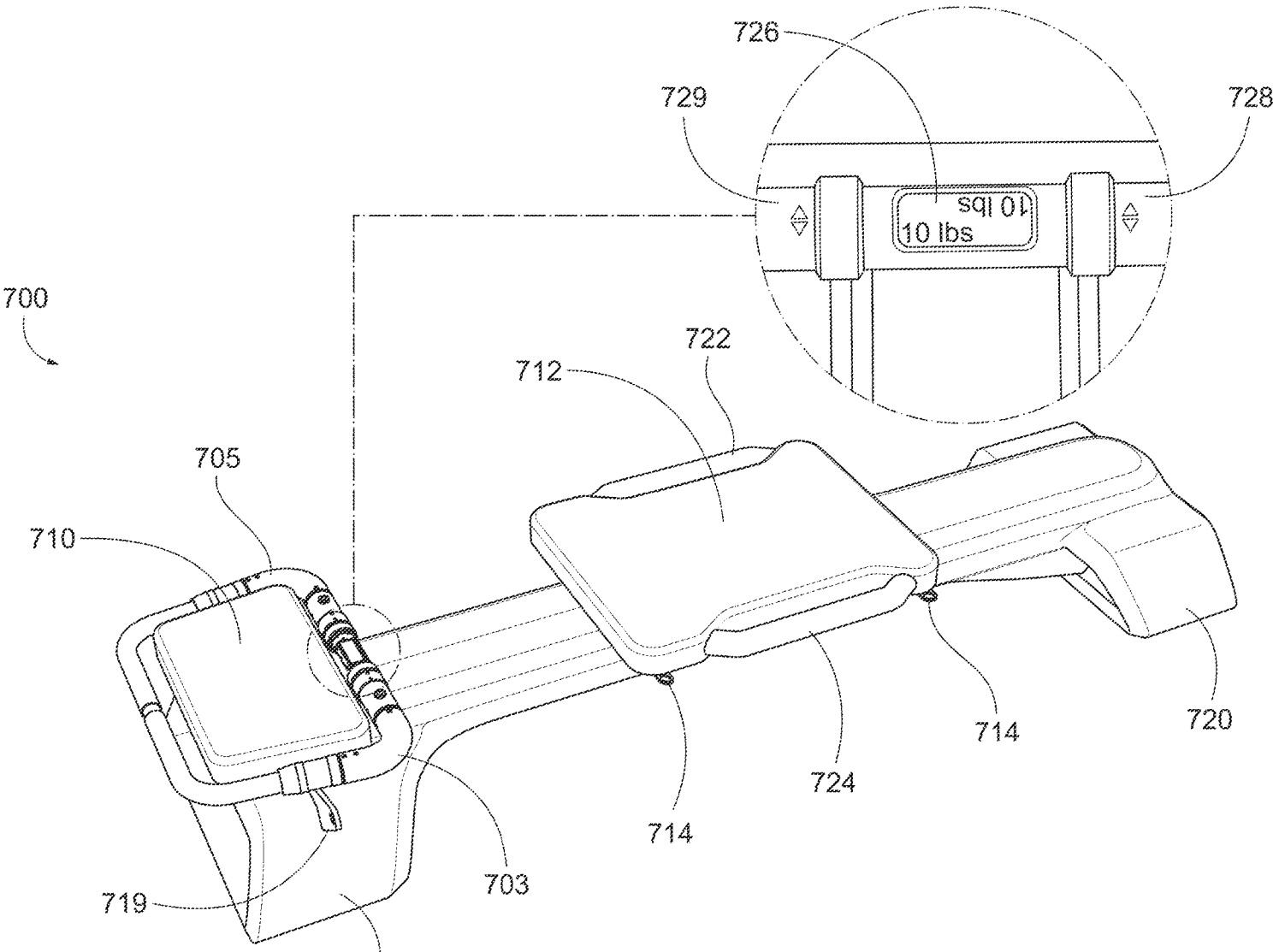
FIG. 7A illustrates a first perspective view of an example exercise apparatus, in accordance with one or more implementations.
Figure 7B:
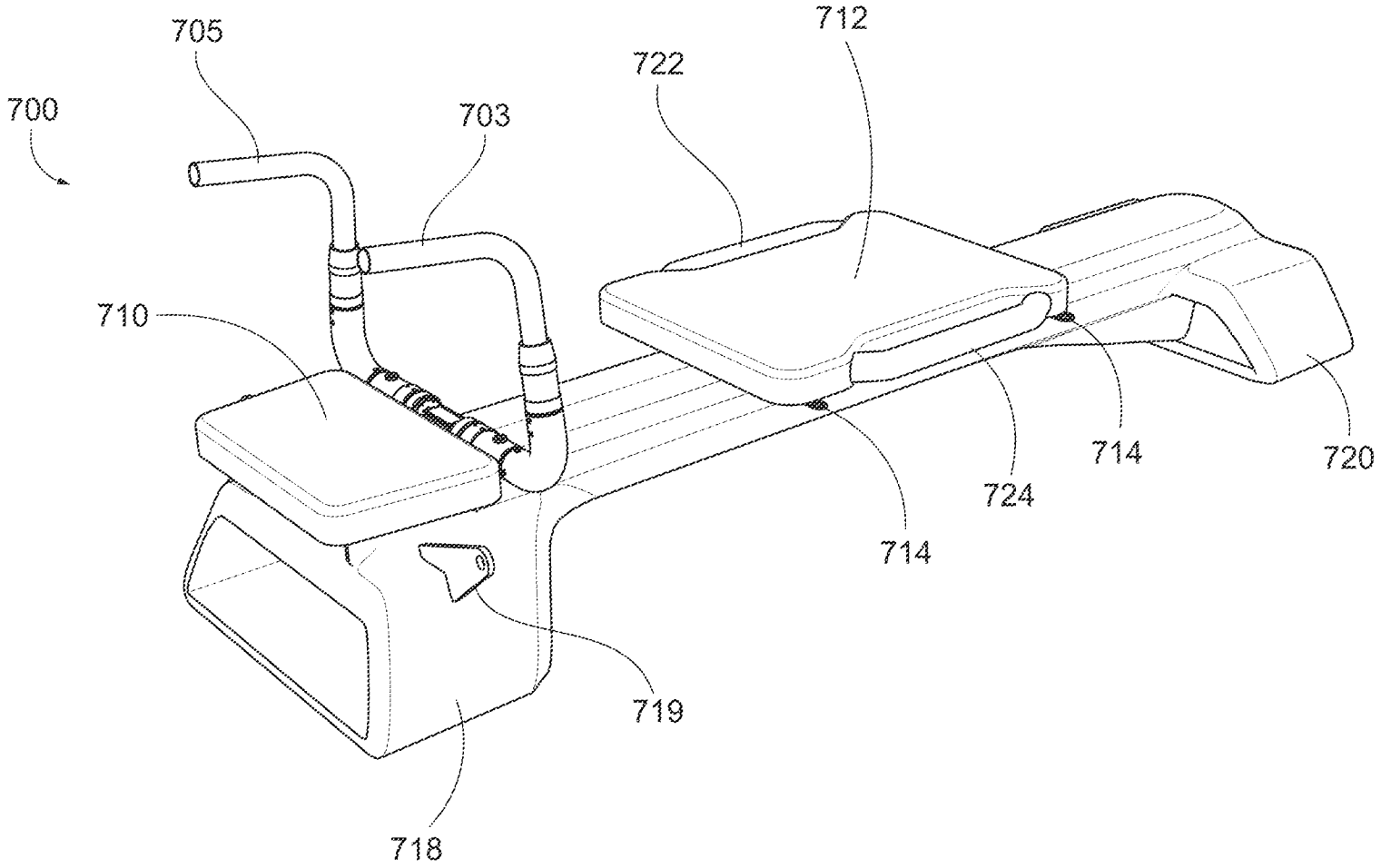
FIG. 7B illustrates a second perspective view of the example exercise apparatus of FIG. 7A, in accordance with one or more implementations.
Figure 7C:
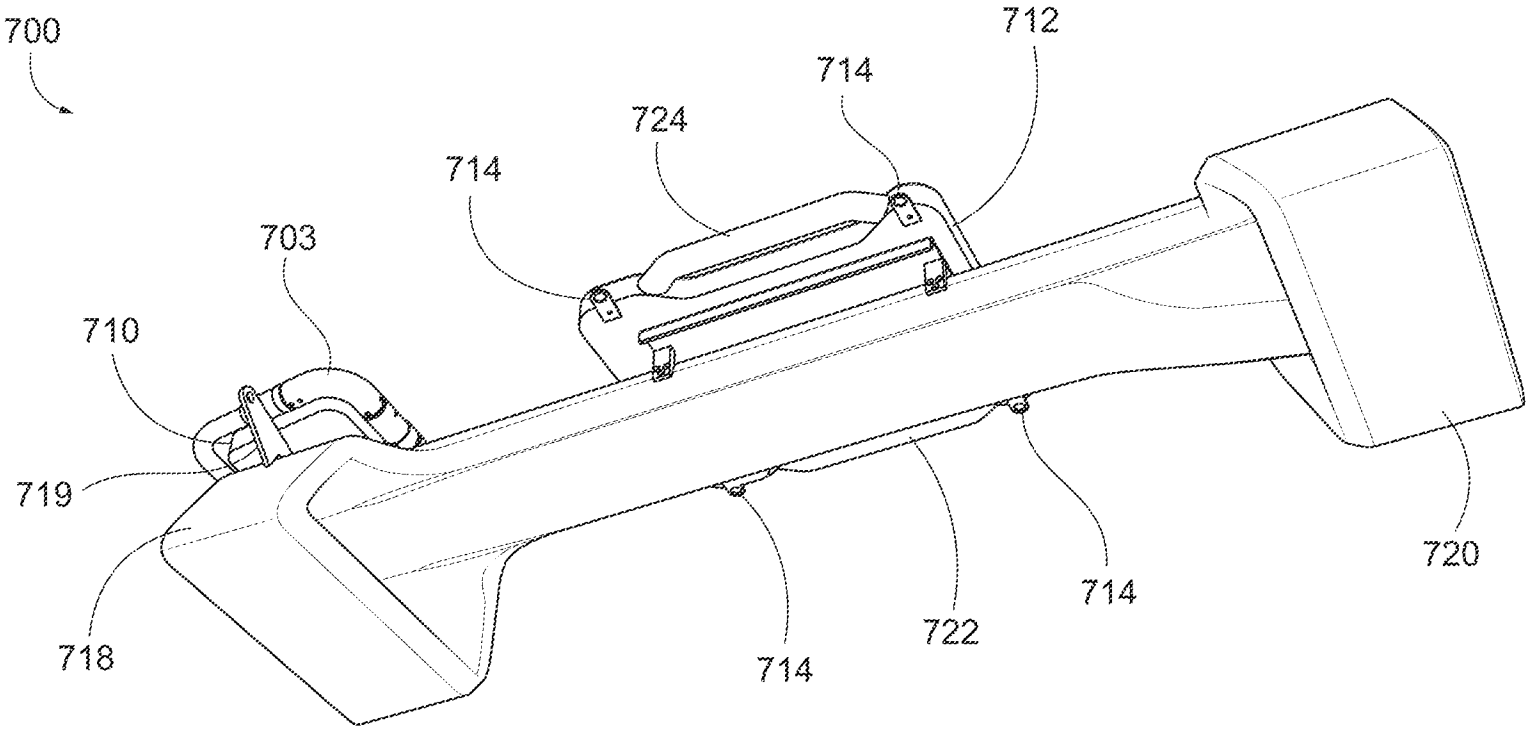
FIG. 7C illustrates a third perspective view of the example exercise apparatus of FIG. 7A, in accordance with one or more implementations.

FIG. 7A illustrates an example embodiment of an exercise apparatus 700 utilizing a pulley system to provide resistance. FIG. 7B similarly shows an example embodiment of an exercise apparatus 700 arranged with arms 703 and 705 arranged in a different configuration. FIG. 7C shows a bottom view of exercise apparatus 700. The components of exercise apparatus 700 are supported by two bases, seat base 718 and motor base 720. A track 736 extends between seat base 718 and motor base 720. As illustrated, track 736 includes first rail 736' and second rail 736", but in alternative embodiments one or three or more rails can be utilized. While first and second rails 736' and 736" are shown as tubular members, other geometries can be employed (e.g., cross sections with alternative rounded geometry, cross sections with polygonal geometry, combinations thereof, beams with flanges, et cetera) without departing from the scope or spirit of the innovation. In the illustrated embodiment, seat guide 776 couples first rail 736' to seat base 718; motor guide 766 couples first rail 736' to motor base 720; seat guide 778 couples second rail 736" to seat base 718; and motor guide 768 couples second rail 736" to motor base 720. Other manners of attachment (e.g., pinning, welding, threading, guide formed as a unitary element with base, et cetera) can be utilized in alternative or complementary embodiments without departing from the scope or spirit of the innovation. Bases can also include additional attachments points for springs, cables, or other accessories, such as, e.g., base attachment point 719. Also running between seat base 718 and motor base 720 are one or more cables as described herein.

Seat base 718 can include a seat 710 disposed on a top side of seat base 718. The seat can be a cushioned or include a non-slip material, or other suitable material or combination thereof. Arms 703 and 705 are also coupled to seat base 710. In embodiments, arms 703 and 705 are rotatably coupled to seat base 718. Arms 703 and 705 can be rotatable at more than one position, e.g., as shown in FIG. 7B, where first portions of the arms 703 and 705 are rotated vertically (e.g., approximately perpendicular to track 736) and second portions of the arms 703 and 705 are rotated forward (e.g., approximately parallel to track 736). In embodiments, pop pins can be used to lock or release portions of arms 703 and 705 for rotation. In embodiments, the second portions of arms 703 and 705 can be a handle. One or more portions of arms 703 and 705 can include material to aid user grip, be flared or tapered, or be wider or narrower in diameter, without departing from the scope or spirit of the innovation.

Exercise apparatus 700 includes a carriage 730 configured to travel along track 736. Carriage 730 can include components for coupling carriage 730 with track 736, such as guides or clasps. Components for coupling carriage 730 with track 736 can removably or irremovably couple carriage 730 with track 736. For example, guides could only wrap around a portion of track 736 to allow carriage 730 to be removed without tools. Alternatively hardware utilizing screws, pins, latches, or other parts for fixing or attaching can be used such that carriage 730 is attached to track 736 until a user removes or opens the attaching elements. In another alternative, carriage 730 can be permanently attached to track 736 (e.g., removal of carriage 730 from track 736 requires cutting or irreversible deformation of a component). Carriage 730 can have a backrest 712 as well as one or more handles 722 and 724. Backrest 712 can be a cushion, non-slip material, or other appropriate material, or combination thereof. In alternative embodiments, handles can be disposed on any other portion of carriage 730 and/or backrest 712, and such handles may be fixed or movable. In embodiments, carriage 730, backrest 712, and/or one or both of seat base 718 and motor base 720 can have dampeners, buffers, or cushion material to prevent slamming of carriage 730 and/or backrest 712 against one or both of seat base 718 and motor base 720. Carriage 730 and/or backrest 712 can include one or more backrest attachment points 714 integrated thereon to allow for securing of the carriage 730/backrest 712 into one position on track 736, or the attachments of springs, cables, or other accessories to carriage 730/backrest 712.

Figure 8A:
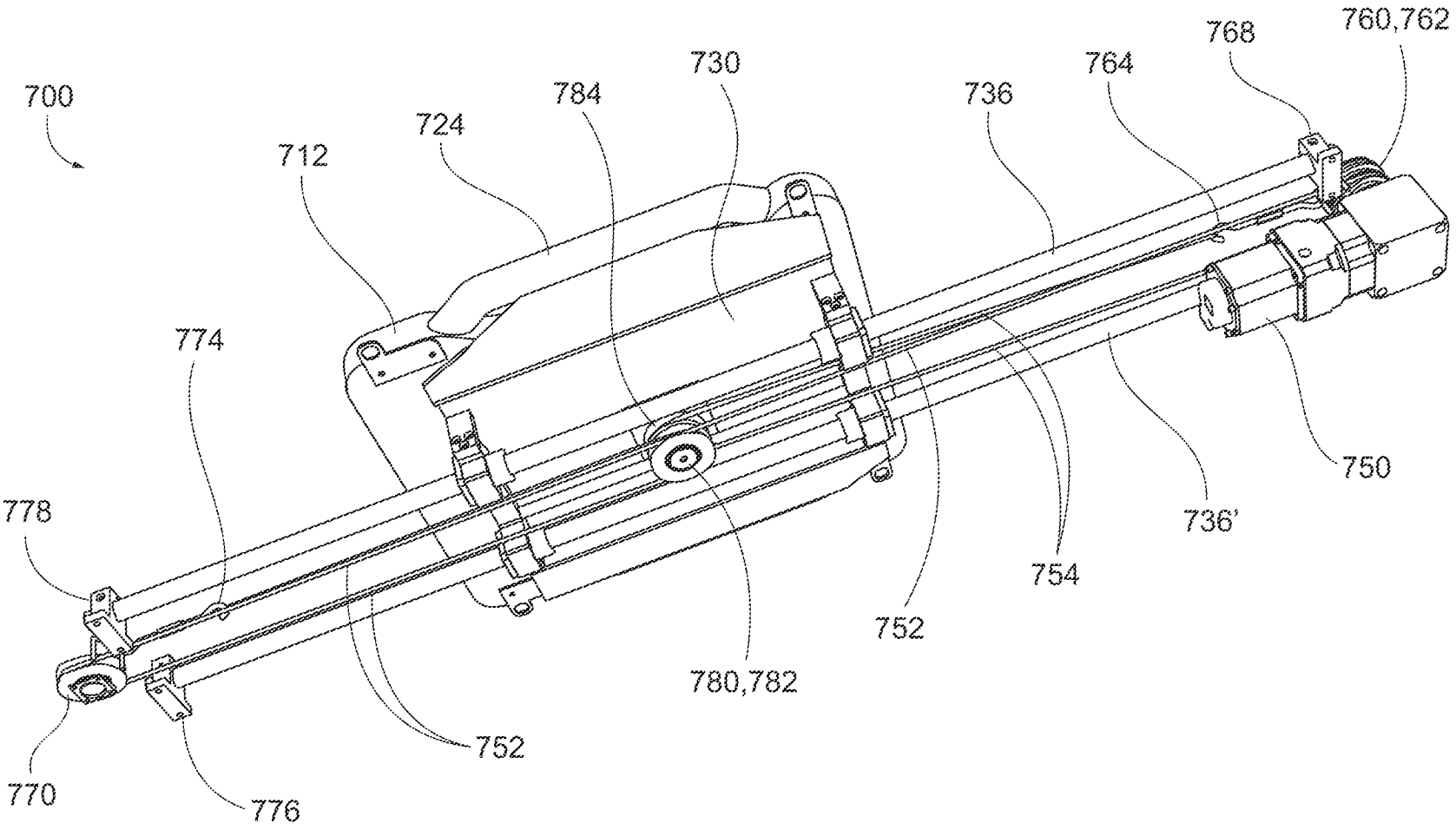
FIG. 8A illustrates a first cutaway/partially-exploded view of the example exercise apparatus of FIG. 7A, in accordance with one or more implementations.
Figure 8B:
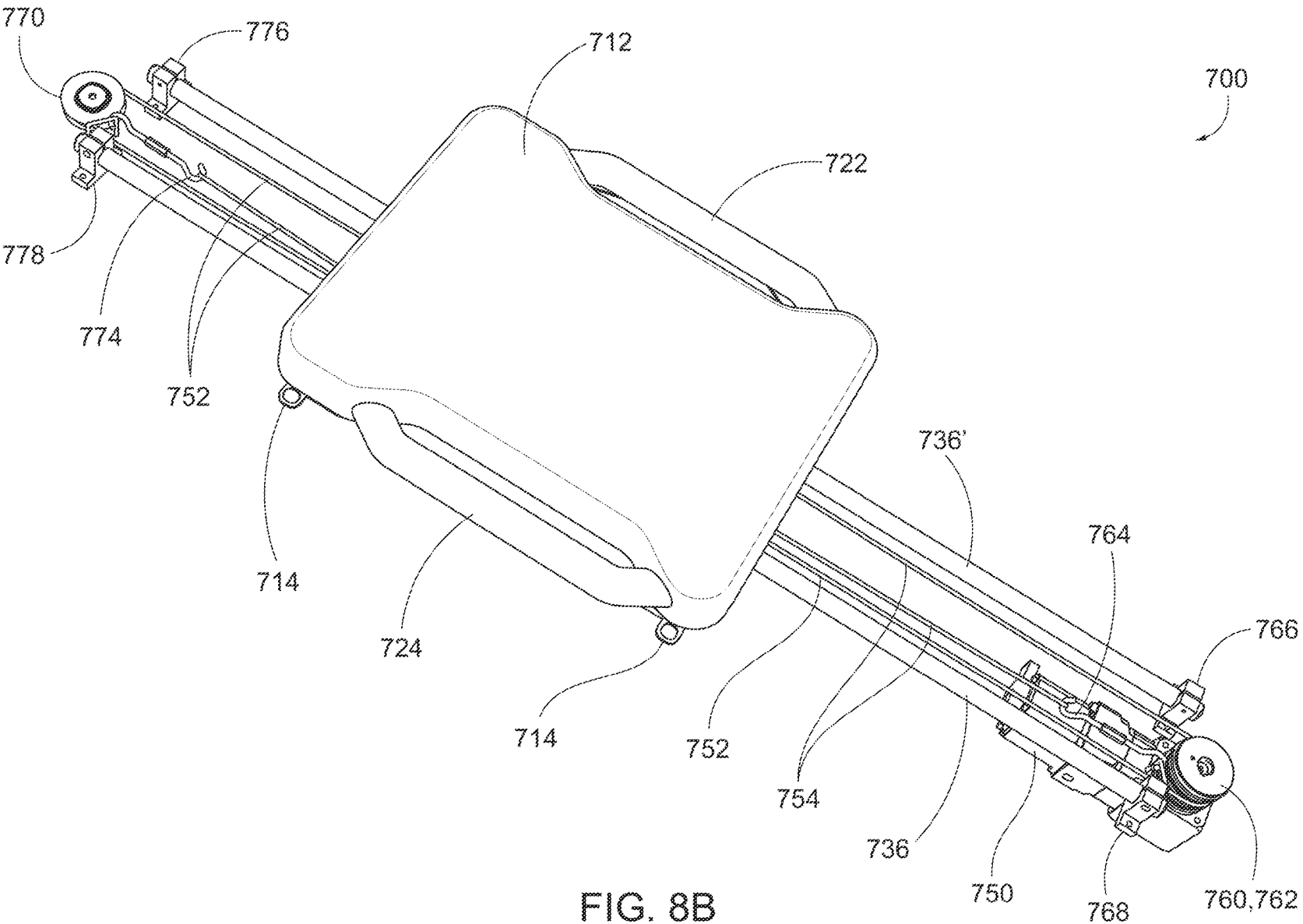
FIG. 8B illustrates a first cutaway/partially-exploded view of the example exercise apparatus of FIG. 7A, in accordance with one or more implementations.
Figure 8C:
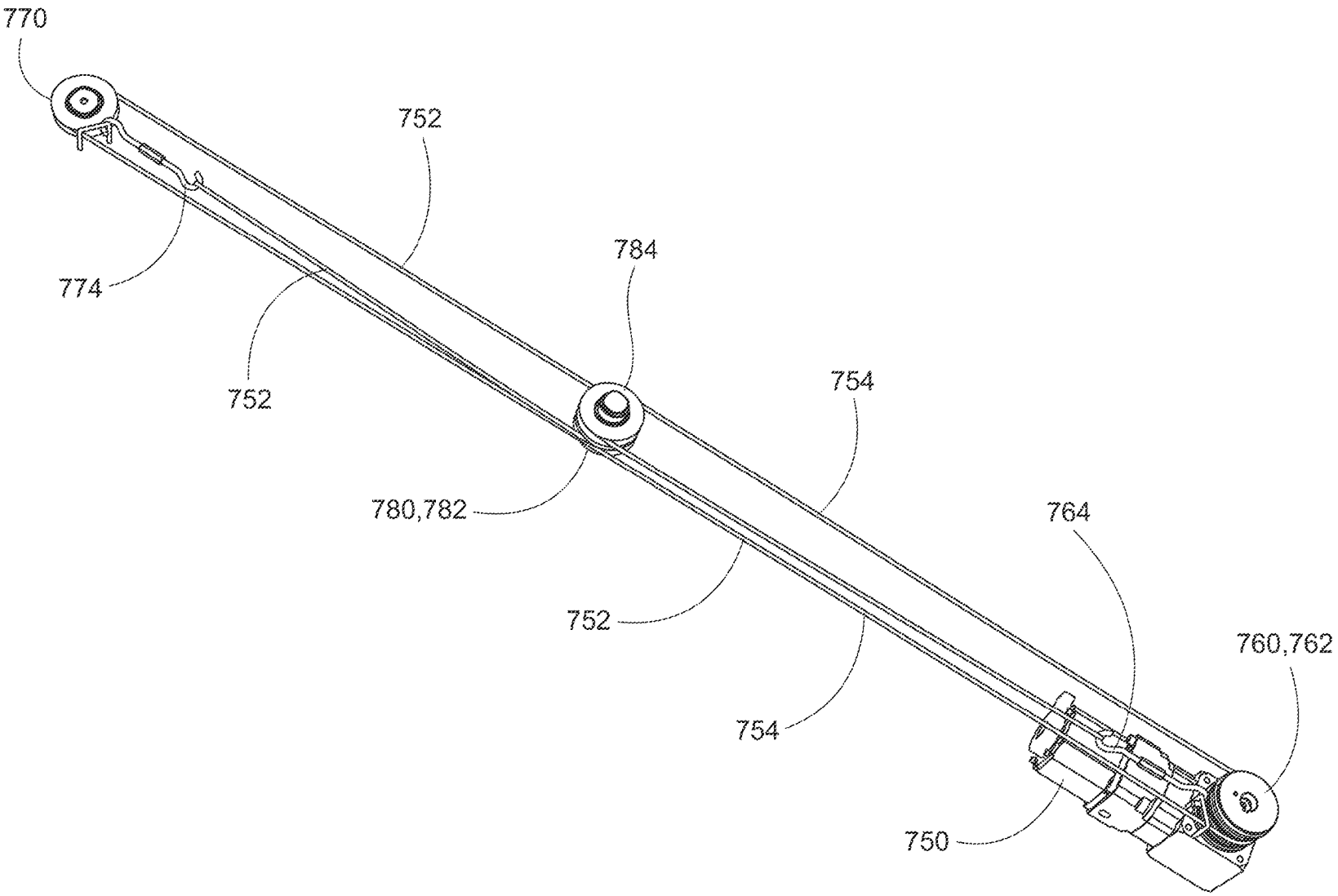
FIG. 8C illustrates a first cutaway/partially-exploded view of the example exercise apparatus of FIG. 7A, in accordance with one or more implementations.

FIGS. 8A-8C illustrate partial cutaway views excluding parts of exercise apparatus 700 to provide views of the pulley system used to provide resistance and/or convey carriage 730 and backrest 712 along track 736. Two cables 752 and 754 wrap around motor pulleys 760 and 762. In embodiments, a single motor pulley can be used, or three or more motor pulleys can be used, in lieu of or in combination with motor pulleys 760 and 762. Motor pulleys 760 and 762 are operatively coupled with motor 750, which can turn motor pulleys 760 and 762 to convey carriage 730 and backrest 712 along track 736, or provide variable resistance to a user exerting force on backrest 712 and/or track 736 (or other components operatively coupled with cables 752 and 754, such as movable arms or cables for strength training) based on the motor force resisting the user's motion. Two backrest pulleys 780 and 782 are shown attached to carriage 730 and backrest 712. The backrest pulleys 780 and 782 can be attached to carriage 730 using a carriage pulley attachment 784. In embodiments, a single backrest pulley can be used, or three or more backrest pulleys can be used, in lieu of or in combination with backrest pulleys 780 and 782. Exercise apparatus 700 also has a seat pulley 770. In embodiments, more than one seat pulley can be used.

In the embodiment illustrated, first cable 752 attaches to seat hook 774 and extends to backrest pulley 782. First cable 752 wraps around backrest pulley 782 then extends back to seat pulley 770. First cable wraps around seat pulley 770 then extends past backrest pulley 782 (without wrapping) to motor pulley 762. First cable wraps several times around motor pulley 762 before being fixed into the wheel of motor pulley 762. In this manner, first cable 752 can spool around motor pulley 762 or seat pulley 770 based on the positioning of carriage 730 and backrest 712, and exert resistance on the motion of carriage 730 and backrest 712, or impart motion onto carriage 730 and backrest 712, using force imparted from motor 750.

First and second cables 752 and 754 can be formed of any appropriate material. In an embodiment, first and second cables are the same material and/or specification. In alternative embodiments, first and second cables can be different materials and/or specifications. In this manner, the use of two or more motor pulleys 760 and 762, and two or more backrest pulleys, 780 and 782, can provide pulleys configured to work with a specific cable type. In embodiments, cables can be formed of metal, polymer, rubber, or any other suitable material, or combinations thereof. In embodiments, cables can be metal cables wrapped in plastic, rubber, and/or other materials. In an embodiment, one or more cables can alternatively be chains (made of, e.g., any material described herein), belts (e.g., flat or with teeth), or tracks, and pulleys can be configured to engage such cables or alternatives (e.g., comprising gears or sprockets).

Motor 750 can be, e.g., a stepper motor, or any appropriate motor for directly or indirectly turning motor pulleys 760 and 762. In embodiments, a motor (replacing or supplementing motor 750) can be provided in seat base 718 to act on seat pulley 770 and second cable 754 to impart motion or resistance to motion to carriage 730 and backrest 712. Motor 750 can be powered using an electrical connection. The electrical connection can include a cable or plug, or receptacle for accepting a cable or plug, disposed in or on motor base 720, or elsewhere in exercise apparatus 700. In an alternative or complementary embodiment, one or both of motor base 720 and seat base 718 can include a battery that is electrically coupled to one or both of motor 750 and/or display 726 and adjustment mechanisms 728 and 729.

In the embodiment illustrated, second cable 754 connects to motor hook 764 and extends around backrest pulley 780 before returning to spool around motor pulley 760 and being fixed thereto. Based on force imparted from motor 750, second cable 754 can spool around motor pulley 760 based on the positioning of carriage 730 and backrest 712, and exert resistance on the motion of carriage 730 and backrest 712, or impart motion onto carriage 730 and backrest 712. As second cable 754 unspools, the loop is made larger allowing carriage 730 and backrest 712 to move away from motor pulley 760 along track 736.

The cables and pulleys herein can be complemented with additional elements or arranged in a variety of different ways without departing from the scope or spirit of the innovation. In embodiments, some or all of cables 752 and 754 can be enclosed to protect the cables and prevent interference or injury. In embodiments, a housing or floor can be provided, spanning some or all of the space between seat base 718 and motor base 720, to enclose the moving parts below carriage 730, arranged with gaps or otherwise shaped to avoid interfering with the motion of carriage 730 and backrest 712 along track 736. In embodiments, pulleys and cables need not be disposed below the track, but can be disposed to one side or another, and/or be mounted lower in one or both bases. In embodiments, the orientation of pulleys and cables can be changed rotationally (e.g., 90 degrees from how they are shown) such that loops of the cable run over and under one another rather side-by-side as illustrated.

The resistance applied to cables 752 and 754 can be indicated using display 726. Display 726 includes adjustment mechanisms 728 and 729. In the illustrated embodiment, the amount of resistance is displayed on display 726, and adjustment mechanisms 728 and 738 can be used (e.g., spinning one way or the other) to increase or decrease resistance on carriage 730. In embodiments, the resistance can be displayed on display 726 in duplicate, with one inverted from the other, for ease of reading regardless of how arms 703 and 705 are rotated or the exercise being performed. Alternatively, display 726 can be operatively coupled to a sensor that identifies the orientation of display 726 and/or an exercise being performed, and the sensor information can be used to properly display the resistance to a user on display 726. In embodiments, another action on one or both of adjustment mechanism(s) 728 and 729 (e.g., depressing one or both wheels) reverses the direction of resistance.

In embodiments, adjustment mechanisms 728 and 729 are coupled with a controller, and in further embodiments the controller may be configured to transmit or receive signals wirelessly. In such embodiments, a user could also use an application to send control signals (e.g., to change the amount or direction of resistance) to the controller. In embodiments, resistance is controlled using motor 750. Motor 750 can in embodiments include such a controller, or may be operatively coupled to a controller disposed elsewhere in or on exercise apparatus 700. In embodiments where motor 750 provides resistance and motor 750 does not include the controller, a variety of techniques can be utilized to operatively couple motor 750 and the controller (e.g., wires inside track 736, wires below or alongside the moving parts, wireless communication using Bluetooth or Wi-Fi, et cetera). Display 726 can likewise be coupled to motor 750, the controller, or other elements in order to receive a signal representative of the amount and/or direction of resistance for display.

It should be understood that aspects of FIGS. 1-6 and aspects of FIGS. 7-10 can be substituted or combined without departing from the scope or spirit of the innovation. For example, a cable system (e.g., the components of exercise apparatus 100 terminating in cable handles 102 and 104) can be integrated with exercise apparatus 700. Similarly, a multi-position backrest capable of being raised or inclined at different angles to carriage 730 and/or track 736 can be utilized with exercise apparatus 700. Alternatively, a cable drive system (e.g., using step motor 750, cables 752 and 754, and/or pulleys 760, 762, 770, 780, and 782, et cetera) can be utilized with exercise apparatus 100 or similar exercise apparatuses. This is not an exhaustive listing of possible alternatives, and those of ordinary skill in the art will appreciate other modifications between embodiments herein allowing aspects of one to be used with or exchanged for aspects of another, and nothing herein should be read to limit such alternatives or combinations.

Figure 9:
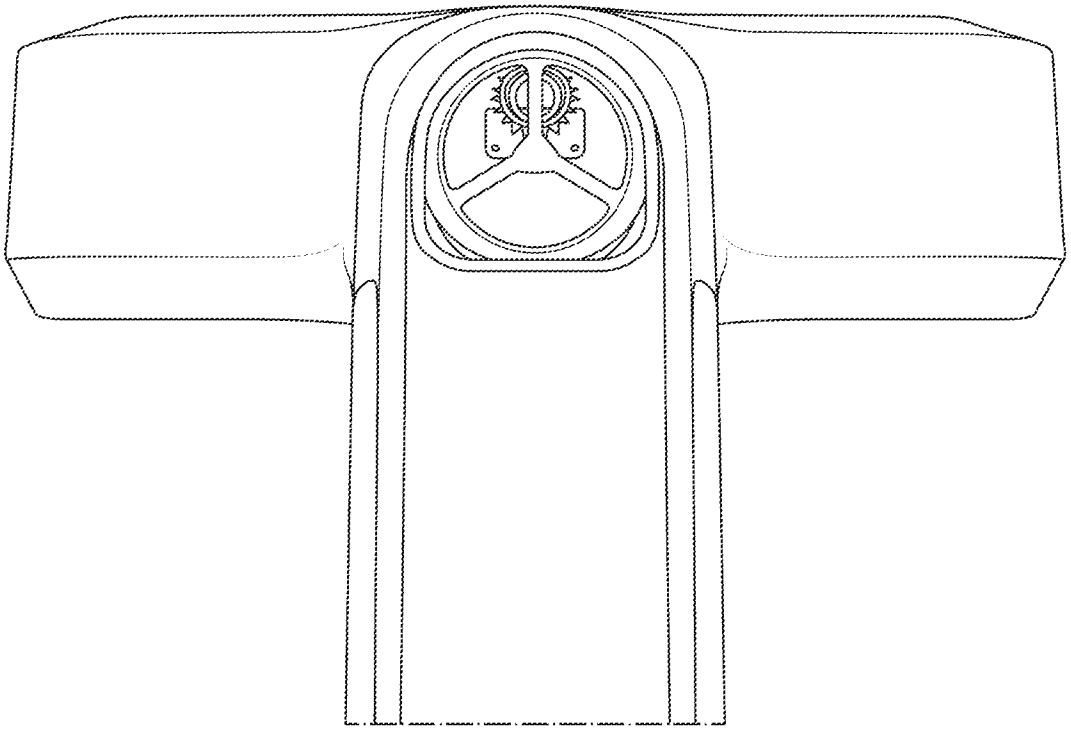
FIG. 9 illustrates an example base of an exercise apparatus disclosed herein, in accordance with one or more implementations.

FIG. 9 illustrates an example enclosure that can be provided on a base to an exercise apparatus such as exercise apparatus 100 or exercise apparatus 700. In embodiments, the enclosure can include a window that permits a user to see one or more of pulleys, gears, cables, a motor, et cetera, within the base. In embodiments, the window of the enclosure can be opened to access parts within the base. In embodiments the window is provided in base 120 of exercise apparatus 100 or base 720 of exercise apparatus 700. In embodiments the window is provided on another base of an exercise apparatus, such as base 118 or base 718.

Figure 10:
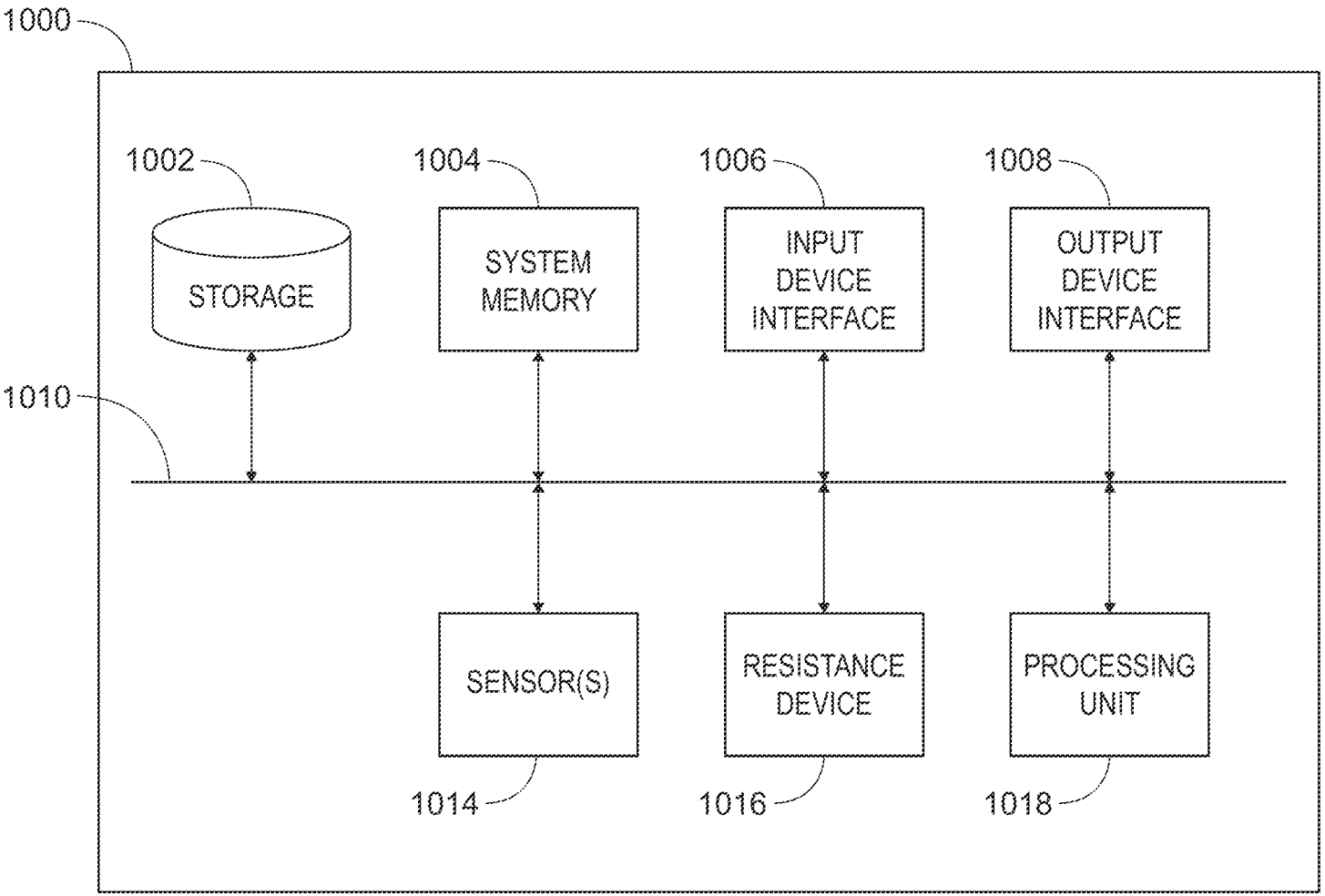
FIG. 10 illustrates an electronic device with which one or more implementations of the subject technology may be implemented.

FIG. 10 illustrates an electronic component 1000 with which one or more implementations of the subject technology may be implemented. The electronic component 1000 can be a part of the apparatus 100 and/or a separate device affixed to the apparatus 100. The electronic component 1000 may include various types of computer-readable media and interfaces for various other types of computer-readable media. The electronic component 1000 includes a bus 1010, a processing unit 1018, a system memory 1004, a storage device 1002, an input device interface 1006, an output device interface 1008, sensor(s) 1014, electronic resistance device 1016, and a network interface 1012, or subsets and variations thereof.

The bus 1010 collectively represents all system, peripheral, and chipset buses that communicatively connect the numerous internal devices of the electronic component 1000. In one or more implementations, the bus 1010 communicatively connects the processing unit 1018 with the other components of the electronic component 1000. From various memory units (e.g., the system memory 1004), the processing unit 1018 retrieves instructions to execute and data to process in order to execute the operations of the subject disclosure. The processing unit 1018 can be a controller and/or a single- or multi-core processor or processors in various implementations.

The storage device 1002 may be a read-and-write memory device. The storage device 1002 may be a non-volatile memory unit that stores instructions and data (e.g., static and dynamic instructions and data) even when the electronic component 1000 is off. In one or more implementations, a mass-storage device (such as a magnetic or optical disk and its corresponding disk drive) may be used as the storage device 1002. In one or more implementations, a removable storage device (such as a floppy disk, flash drive, and its corresponding disk drive) may be used as the storage device 1002.

Like the storage device 1002, the system memory 1004 may be a read-and-write memory device. However, unlike the storage device 1002, the system memory 1004 may be a volatile read-and-write memory, such as random access memory. The system memory 1004 may store any of the instructions and data that one or more processing unit 1018 may need at runtime to perform operations. In one or more implementations, the processes of the subject disclosure are stored in the system memory 1004 and/or the storage device 1002. From these various memory units, the one or more processing unit 1018 retrieves instructions to execute and data to process in order to execute the processes of one or more implementations.

The bus 1010 also connects to the input device interface 1006 and output device interface 1008. The input device interface 1006 enables the system to receive inputs. For example, the input device interface 1006 allows a user to communicate information and provide commands to the electronic component 1000. The input device interface 1006 may be used with input devices such as keyboards, mice, and other user input devices as well as microphones, cameras, and other sensor devices (e.g., sensors 1014). The output device interface 1008 may enable, for example, the display of images, such as images generated by electronic component 1000 or received via the input device interface 1006. Output devices that may be used with the output device interface 1008 may include, for example, printers and display devices, such as a liquid crystal display (LCD), a light emitting diode (LED) display, an organic light emitting diode (OLED) display, a flexible display, a flat panel display, a solid state display, an e-ink/e-paper display, or any other device for outputting information. One or more implementations may include devices that function as both input and output devices, such as a touchscreen. In these implementations, feedback provided to the user can be any form of sensory feedback, such as visual feedback, auditory feedback, or tactile feedback; and input from the user can be received in any form, including acoustic, speech, or tactile input.

The bus 1010 also couples the electronic component 1000 to one or more networks and/or to one or more network nodes (e.g., other electronic devices) through the network interface 1012. The network interface 1012 may include one or more interfaces that allow the electronic component 1000 to be a part of a network of computers (such as a local area network (LAN), a wide area network ("WAN"), or a network of networks (the "Internet")). Any or all components of the electronic component 1000 can be used in conjunction with the subject disclosure.

The electronic component 1000 may also include an electronic resistance device 1016. The electronic resistance device 1016 may be used for controlling the resistance that the user experiences when pulling a cable handle (e.g., cable handles 102, 104), moving the carriage 130 or 730, or backrest 112 or 712, or performing exercises with any other element of exercise apparatus(es) 100 and 700. The electronic resistance device 1016 may be included and/or be in communication with a tension gauge to determine whether it is applying the appropriate amount of resistance. The electronic resistance device 1016 may be an electronic and/or mechanical module. An electronic resistance module may utilize electrically-based mechanisms for providing resistance, such as an electric motor, an electronic linear actuator, and the like. A mechanical resistance module may utilize mechanically-based mechanisms for providing resistance, such as springs, pullies, hydraulics, and the like.

For example, an electronic resistance device 1016 may include an electric mechanical device, such as an induction motor, whose rotor is coupled to a resistance cable and includes a plurality of gears for adjusting the resistance. The motor may be configured to rotate one or more gears and/or adjust the gear ratio of the gears. The motor may increase resistance applied to the cable handles (e.g., cable handles 102, 104), carriage 130 or 730, or backrest 112 or 712, or other movable elements of or coupled with exercise apparatus(es) 100 or 700 by increasing the power of the motor and/or adjusting the gear ratio, which results in the user having to exert more force to work against.

The electronic component 1000 also includes one or more sensors 1014. The sensors 1014 may be used for generating exercise data, receiving user input (e.g., to supply to the input device interface 1006), and the like. For example, sensors 1014 may include a pressure sensor, proximity sensor, bioimpedance sensor, and the like, to determine whether a user is on the mat. As another example, sensors 1014 may also include a capacitive touch sensor for the user to provide input. The sensors 1014 may also include a tension gauge for determining the amount of resistance applied by the resistance module and/or the amount of force applied by the user.

Implementations within the scope of the present disclosure can be partially or entirely realized using a tangible computer-readable storage medium (or multiple tangible computer-readable storage media of one or more types) encoding one or more instructions. The tangible computer-readable storage medium can also be non-transitory in nature.

The computer-readable storage medium can be any storage medium that can be read, written, or otherwise accessed by a general purpose or special purpose computing device, including any processing electronics and/or processing circuitry capable of executing instructions. For example, without limitation, the computer-readable medium can include any volatile semiconductor memory (e.g., the system memory 1004), such as RAM, DRAM, SRAM, T-RAM, Z-RAM, and TTRAM. The computer-readable medium can also include any non-volatile semiconductor memory (e.g., the storage device 1002), such as ROM, PROM, EPROM, EEPROM, NVRAM, flash, nvSRAM, FeRAM, FeTRAM, MRAM, PRAM, CBRAM, SONOS, RRAM, NRAM, racetrack memory, FJG, and Millipede memory.

Further, the computer-readable storage medium can include any non-semiconductor memory, such as optical disk storage, magnetic disk storage, magnetic tape, other magnetic storage devices, or any other medium capable of storing one or more instructions. In one or more implementations, the tangible computer-readable storage medium can be directly coupled to a computing device, while in other implementations, the tangible computer-readable storage medium can be indirectly coupled to a computing device, e.g., via one or more wired connections, one or more wireless connections, or any combination thereof.

Instructions can be directly executable or can be used to develop executable instructions. For example, instructions can be realized as executable or non-executable machine code or as instructions in a high-level language that can be compiled to produce executable or non-executable machine code. Further, instructions can also be realized as or can include data. Computer-executable instructions can also be organized in any format, including routines, subroutines, programs, data structures, objects, modules, applications, applets, functions, etc. As recognized by those of skill in the art, details including, but not limited to, the number, structure, sequence, and organization of instructions can vary significantly without varying the underlying logic, function, processing, and output.

While the above discussion primarily refers to microprocessors or multi-core processors that execute software, one or more implementations are performed by one or more integrated circuits, such as ASICs or FPGAs. In one or more implementations, such integrated circuits execute instructions that are stored on the circuit itself.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Any of the blocks may be performed simultaneously. In one or more implementations, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

As used in this specification and any claims of this application, the terms "base station," "receiver," "computer," "server," "processor," and "memory" all refer to electronic or other technological devices. These terms exclude people or groups of people. For the purposes of the specification, the terms "display" or "displaying" means displaying on an electronic device.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The predicate words "configured to," "operable to," and "programmed to" do not imply any particular tangible or intangible modification of a subject, but, rather, are intended to be used interchangeably. In one or more implementations, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

Phrases such as an aspect, the aspect, another aspect, some aspects, one or more aspects, an implementation, the implementation, another implementation, some implementations, one or more implementations, an embodiment, the embodiment, another embodiment, some implementations, one or more implementations, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration." Any embodiment described herein as "exemplary" or as an "example" is not necessarily to be construed as preferred or advantageous over other implementations. Furthermore, to the extent that the term "include," "have," or the like is used in the description or the claims, such term is intended to be inclusive in a manner similar to the phrase "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f), unless the element is expressly recited using the phrase "means for" or, in the case of a method claim, the element is recited using the phrase "step for."

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) may be used generally to refer to both masculine and feminine pronouns. Headings and subheadings, if any, are used for convenience only and do not limit the subject disclosure.

What is claimed is:

1. An exercise device comprising:
- a first base comprising:
  - a pair of support handles rotatably connected to the first base;
  - a pair of cable arms rotatably connected to the first base;
  - a first engagement mechanism;
  - an electronic resistance device connected to a pair of cable handles via a pair of cables that pass through a pair of channels defined by the pair of cable arms; and
  - a seat; and
- a second base comprising:
  - a beam affixed to and connecting the first base and the second base;
  - wherein the beam comprises:
    - a track;
    - a backrest carriage, slidably engaged with the track, comprising a second engagement mechanism and a third engagement mechanism; and
    - a backrest rotatably connected to an end of the backrest carriage.

2. The exercise device of claim 1, wherein the electronic resistance device is connected to the pair of cable handles such that, when the first engagement mechanism of the first base is engaged with the second engagement mechanism of the backrest carriage, the electronic resistance device is engaged and applies a resistance to the corresponding cable.

3. The exercise device of claim 1, wherein at least one of the second base and the beam further comprises a fourth engagement mechanism.

4. The exercise device of claim 3, wherein the electronic resistance device is deactivated when the third engagement mechanism of the backrest carriage is engaged with the fourth engagement mechanism.

5. The exercise device of claim 1, wherein the backrest carriage further comprises a support for holding the backrest in an inclined position.

6. The exercise device of claim 1, wherein the pair of cable handles is connected to the pair of cables via a clip such that the pair of cable handles is configured to be replaced with a second pair of cable handles.

7. The exercise device of claim 1, wherein the electronic resistance device comprises one or more adjustment mechanisms, wherein the one or more adjustment mechanisms change at least one of an amount of resistance or a direction of resistance applied to the pair of cables by the electronic resistance device.

8. The exercise device of claim 1, wherein the electronic resistance device further comprises a display, wherein the display presents an amount of resistance applied to the pair of cables by the electronic resistance device.

9. The exercise device of claim 1, wherein the backrest carriage further comprises a pair of carriage handles on opposing sides of the backrest carriage, wherein the opposing sides face away from the first base and the second base and the pair of carriage handles are engageable with the backrest for securing the backrest to the backrest carriage.

10. An exercise device comprising:
- a base comprising:
  - a pair of support handles rotatably connected to the base;
  - a pair of cable arms rotatably connected to the base;
  - a first engagement mechanism;
  - an electronic resistance device connected to a pair of cable handles via a pair of cables that pass through a pair of channels defined by the pair of cable arms; and
  - a seat; and
- a beam, affixed to the base, comprising:
  - a track;
  - a backrest carriage, slidably engaged with the track, comprising a second engagement mechanism and a third engagement mechanism; and
  - a backrest rotatably connected to an end of the backrest carriage.

11. The exercise device of claim 10, wherein the electronic resistance device is connected to the pair of cable handles such that, when the first engagement mechanism of the base is engaged with the second engagement mechanism of the backrest carriage, the electronic resistance device is engaged and applies a resistance to the corresponding cable.

12. The exercise device of claim 10, wherein at least one of the base and the beam further comprises a fourth engagement mechanism.

13. The exercise device of claim 12, wherein the electronic resistance device is deactivated when the third engagement mechanism of the backrest carriage is engaged with the fourth engagement mechanism.

14. The exercise device of claim 10, wherein the backrest carriage further comprises a support for holding the backrest in an inclined position.

15. The exercise device of claim 10, wherein the pair of cable handles is connected to the pair of cables via a clip such that the pair of cable handles is configured to be replaced with a second pair of cable handles.

16. The exercise device of claim 10, wherein the electronic resistance device comprises one or more adjustment mechanisms, wherein the one or more adjustment mechanisms change an amount of resistance applied to the pair of cables by the electronic resistance device, and wherein the electronic resistance device further comprises a display, wherein the display presents an amount of resistance applied to the pair of cables by the electronic resistance device.

* * * * *